US012629797B2

(12) United States Patent
Zhang et al.

(10) Patent No.: US 12,629,797 B2
(45) Date of Patent: May 19, 2026

(54) DEVICE FOR SUPPLYING AND RECOVERING MINIMAL QUANTITY LUBRICANT IN MAGNETIC FIELD-ASSISTED ABRASIVE GRINDING

(71) Applicants: QINGDAO UNIVERSITY OF TECHNOLOGY, Qingdao (CN); HANERGY (QINGDAO) LUBRICATION TECHNOLOGY CO., LTD., Qingdao (CN)

(72) Inventors: Yanbin Zhang, Qingdao (CN); Wenyi Li, Qingdao (CN); Xin Cui, Qingdao (CN); Changhe Li, Qingdao (CN); Zongming Zhou, Qingdao (CN); Shuaiqiang Xu, Qingdao (CN); Bo Liu, Qingdao (CN); Yun Chen, Qingdao (CN)

(73) Assignees: QINGDAO UNIVERSITY OF TECHNOLOGY, Qingdao (CN); HANERGY (QINGDAO) LUBRICATION TECHNOLOGY CO., LTD., Qingdao (CN)

( * ) Notice: Subject to any disclaimer, the term of this patent is extended or adjusted under 35 U.S.C. 154(b) by 510 days.

(21) Appl. No.: 18/271,393

(22) PCT Filed: Dec. 21, 2022

(86) PCT No.: PCT/CN2022/140740
§ 371 (c)(1),
(2) Date: Jul. 7, 2023

(87) PCT Pub. No.: WO2024/031914
PCT Pub. Date: Feb. 15, 2024

(65) Prior Publication Data
US 2024/0391057 A1 Nov. 28, 2024

(30) Foreign Application Priority Data
Aug. 10, 2022 (CN) ..... 202210955649.3

(51) Int. Cl.
*B24B 55/03* (2006.01)
*B24B 1/00* (2006.01)
(Continued)

(52) U.S. Cl.
CPC ..... *B24B 55/03* (2013.01); *B24B 1/005* (2013.01); *B24B 49/12* (2013.01); *B24B 55/00* (2013.01); *B24B 55/04* (2013.01); *B24B 57/02* (2013.01)

(58) Field of Classification Search
CPC ..... B24B 55/03; B24B 55/04; B24B 55/045; B24B 55/052; B24B 55/12; B24B 55/00;
(Continued)

(56) References Cited

U.S. PATENT DOCUMENTS 5,185,957 A * 2/1993 Mizuguchi ..... B24B 1/005 451/36
5,205,378 A 4/1993 Boelkins
(Continued)

FOREIGN PATENT DOCUMENTS

BR 102019026351 A2 * 6/2021 ..... B01D 15/08
CN 106181596 A 12/2016
(Continued)

OTHER PUBLICATIONS

Apr. 12, 2023 International Search Report issued in International Patent Application No. PCT/CN2022/140740.
(Continued)

*Primary Examiner* — Michael A Gump
(74) *Attorney, Agent, or Firm* — Oliff PLC

(57) ABSTRACT

A device for supplying and recovering a minimal quantity lubricant in a magnetic field-assisted abrasive grinding,
(Continued)

including a grinding wheel guard assembly, including a grinding wheel guard, grinding wheel, and wind deflector; a magnetic worktable mounted on the guard, and a magnetic clamp on the worktable; a controllable magnetic field assembly, including a permanent magnet and a first guide rail mechanism mounted on the deflector, the magnet being connected to the mechanism and to a recovering and filtering device; a controllable nozzle assembly, connected to the deflector on an opposite side of the magnetic field assembly, including a nozzle connected to a linear motion mechanism; and a controlling and monitoring assembly, including a vision camera on the worktable, connected to a system control box. The magnetic nanofluid can exert the optimal lubricating properties and cooling performance under the magnetic field-assisted abrasive grinding, and the magnetic nanoparticles can be further recycled.

13 Claims, 14 Drawing Sheets

(51) Int. Cl.

| | |
|---|---|
| ***B24B 49/12*** | (2006.01) |
| ***B24B 55/00*** | (2006.01) |
| ***B24B 55/04*** | (2006.01) |
| ***B24B 57/02*** | (2006.01) |

(58) Field of Classification Search
CPC ..... B24B 55/02; B24B 49/12; B24B 49/00; B24B 49/04; B24B 49/045; B24B 49/14; B24B 1/005; B24B 41/02; B24B 41/06; B24B 41/00; B24B 41/002; B24B 41/047; B24B 57/02; B24B 57/00; B24B 27/00; B24B 27/06; B24B 27/0038; B24B 27/0046; B24B 27/0053; B24B 27/0683; B24B 7/00; B24B 7/02; B24B 7/07; B24B 7/075; B24B 7/08; B24B 37/005; B24B 37/015; B24B 37/04; B24B 37/042; B24B 37/044; B24B 37/046; B24B 37/34; B24B 51/00; Y02P 70/10
USPC ..... 451/449
See application file for complete search history.

(56) References Cited

U.S. PATENT DOCUMENTS

| | | | | | |
|---|---|---|---|---|---|
| 5,616,066 | A * | 4/1997 | Jacobs | ..... | B24B 9/14 451/36 |
| 2015/0306725 | A1* | 10/2015 | Allin | ..... | B24B 49/12 451/6 |

FOREIGN PATENT DOCUMENTS

| | | | | | |
|---|---|---|---|---|---|
| CN | 208099972 | U | | 11/2018 | |
| CN | 111423929 | A | * | 7/2020 | ..... B24B 57/02 |
| CN | 115488770 | A | | 12/2022 | |
| JP | 2009-235341 | A | | 10/2009 | |

OTHER PUBLICATIONS

Apr. 12, 2023 Written Opinion of the International Searching Authority issued in International Patent Application No. PCT/CN2022/140740.

* cited by examiner

DEVICE FOR SUPPLYING AND RECOVERING MINIMAL QUANTITY LUBRICANT IN MAGNETIC FIELD-ASSISTED ABRASIVE GRINDING

CROSS-REFERENCES TO RELATED APPLICATIONS

This application claims the priority benefit of Chinese application no. 202210955649.3, entitled "Device for supplying and recovering minimal quantity lubricant in magnetic field-assisted abrasive grinding", filed on Aug. 10, 2022. The entirety of each of the above-mentioned patent applications is hereby incorporated by reference herein and made a part of this specification.

TECHNICAL FIELD

The present invention relates to the field of grinding processing devices, and in particular to a device for supplying and recovering minimal quantity lubricant in a magnetic field-assisted abrasive grinding.

BACKGROUND

Nanofluid minimal quantity lubrication (MQL) solves the problem of green high-performance grinding, and has achieved results in shallow grinding and point grinding, but has not been explored in high-efficiency deep grinding. Because the nanofluid minimal quantity lubricant cannot wet the whole grinding zone only by grinding wheel dragging under the complex interface conditions of the air barrier layer and the contact zone of the large arc length of the high-speed rotating grinding wheel. The length of contact arc of the grinding zone is less than 2 mm and is close to a horizontal line under the working conditions of shallow grinding and point grinding, and the nanofluid droplets carried by high-pressure gas and the grinding wheel can wet and pass through the grinding zone, so as to achieve effective cooling and lubrication. However, the maximum length of contact arc of grinding zone in high efficiency deep grinding process can reach up to 80 mm, the area and complexity of micro-channel in grinding zone will change substantially compared with ordinary grinding process, and the range of the deposited film of the nano-particles cannot cover the whole grinding contact zone under the action of magnetic field of grinding magnetic workbench, and the wetting kinetics of the nanofluid minimal quantity lubricant is the technical bottleneck to be solved in its application in high efficiency deep grinding process.

The Chinese Patent Application No. 201820204388.0 (publication No. CN208099972U) discloses a magnetic field assisted plane grinding device, wherein the electromagnet device is arranged on a workbench to make the electromagnet device be reciprocal feed movement along with the workbench, the anchor clamps and the workpiece clamped on the anchor clamps are relatively and fixedly positioned in the middle of two poles, so that the workpiece is always in a magnetic field area. The principle of magnetic field assisted machining is only to apply magnetic field to the surface of workpiece to improve its machining performance, and the magnetic nanofluid is not applied to the machining system, nor can the magnetic field assist to improve the performance of workpiece or utilize the excellent cooling performance and lubricating performance of magnetic nanofluid in the system, so the benefit of deep grinding machining cannot be further improved, and the nanoparticles cannot be recovered and recycled, which cannot meet the maximum requirements of energy saving and environmental protection.

The Chinese Patent Application No. 202010148381.3 (publication No. CN111423929) discloses a nanofluid magnetic grinding fluid and a magnetic field-assisted MQL system, wherein the magnetic ferroferric oxide nanoparticles in the nanofluid magnetic grinding fluid can be adsorbed on the surface of graphene to form magnetic lubrication mixed particles, the nanofluid magnetic grinding fluid forms spray under the action of a MQL device, the magnetic lubrication mixed particles in the spray are uniformly spread in a machining area of a workpiece under the action of the magnetic field assistance device to lubricate and cool, and the magnetic lubrication mixed particles are collected through the recovery container and can be reused. However, the magnetic field assistance system is not controllable, and the optimal position and angle of the magnetic field and the nozzle cannot be adjusted according to the machining data.

It can be seen that although the prior arts have disclosed the magnetic field-assisted grinding, the magnetic nanofluid MQL and the recovery and filtering devices, the following problems exist: 1) there is no adaptive design for the grinding process with large length of the cutting arc (such as high-efficiency abrasive grinding and high-efficiency deep grinding); 2) there is no design adopting the magnetic field assistance based on the nanofluid MQL; 3) the parameters such as the distance between the magnetic field and the grinding zone cannot be regulated and controlled according to the grinding process parameters; 4) the spray angle and target distance of the MQL are not regulated and controlled according to the grinding process parameters, and the magnetic nanofluid does not exert its optimal lubricating properties and cooling performance; and, 5) there is no grinding performance monitoring system.

SUMMARY

In view of the deficiencies of the prior art, it is an object of the present invention to provide a device for supplying and recovering a minimal quantity lubricant in a magnetic field-assisted abrasive grinding, which can adjust the position of the nozzle and permanent magnet to obtain the optimal size of the magnetic field area and the fan spray angle, so that the magnetic nanofluid can perform its optimal lubrication properties and cooling performance under the magnetic field-assisted abrasive grinding machining, and can be detected and monitored by a visual camera; the magnetic nanofluid and impurities can be recovered and filtered after machining, so that the magnetic nanoparticles can be further recycled.

To achieve the above purpose, the present invention is achieved through the following technical solutions:

An example of the present invention provides a device for supplying and recovering a minimal quantity lubricant in a magnetic field-assisted abrasive grinding, comprising:

- a grinding wheel guard assembly, comprising a grinding wheel guard, a grinding wheel mounted inside the grinding wheel guard, and a wind deflector provided on an outside of the grinding wheel; a magnetic workbench mounted on a lower side of the grinding wheel guard, and a magnetic clamp provided on a surface of the magnetic worktable;
- a controllable magnetic field assembly, comprising a permanent magnet and a first guide rail mechanism mounted on a surface of a first side of the wind deflector, the permanent magnet is connected to the first guide rail mechanism to move in a circular direction along the grinding wheel; the permanent magnet is also connected to a recovering and filtering device;

a controllable nozzle assembly, being connected to the wind deflector and located on an opposite side of the controllable magnetic field assembly, comprising a nozzle, being connected to a linear motion mechanism; and a controlling and monitoring assembly, comprising a vision camera disposed on the magnetic worktable for obtaining images of the temperature and wear conditions of a machined surface of a workpiece; the vision camera is connected to a system control box.

As a further implementation, the grinding wheel is mounted in the grinding wheel guard through a spindle clamp;

The one side of the wind deflector is provided with a groove, being in a circular arc shape, for mounting the first guide rail mechanism.

As a further implementation, the first guide rail mechanism comprises an arc-shaped rack guide rail being fixed to the wind deflector and being engaged with a gear being connected to a servo motor;

The gear is mounted on a sliding plate, a clamp plate is connected to the sliding plate through a pillar, and the permanent magnet is mounted in the clamp plate.

As a further implementation, both sides of the arc-shaped rack guide rail are in contact with several rollers being mounted on the sliding plate.

As a further implementation, the recovering and filtering device comprises a peristaltic pump and a filtering assembly, an outlet end of the peristaltic pump being mounted on a top of the grinding wheel guard is connected to a second tube, an inlet end of the peristaltic pump is connected to a first end of a peristaltic pump motor through a fourth tube, a second end of the peristaltic pump motor is connected to a third tube which passes through a hole inside the permanent magnet.

As a further implementation, the nozzle is connected to the wind deflector through a first table with cylinder, and comprises a telescopic front portion, a middle portion and a rear portion set in sequence, and a linear motion mechanism is connected to the telescopic front portion.

As a further implementation, the middle portion of the nozzle comprises a universal bamboo joint tube, and a piston sleeve connected to the universal bamboo joint tube.

The telescopic front portion is matched with the piston sleeve and is capable of telescopic movement along an inside of the piston sleeve.

As a further implementation, the linear motion mechanism is a second guide rail mechanism being connected to a servo motor;

The second guide rail mechanism comprises a guide assembly and a rack mounted in the guide assembly, the rack engaging with the gear.

As a further implementation, the nozzle is rotatably connected to a movable plate through the first table with cylinder, and the linear motion mechanism adopts a hydraulic driving mechanism.

As a further implementation, the hydraulic drive mechanism comprises a hydraulic cylinder, a solenoid reversing valve and an oil delivery tube, the hydraulic cylinder being connected to the solenoid reversing valve via the oil delivery tube.

As a further implementation, the nozzle is connected to a high-pressure gas delivery tube, and a first end of a magnetic nanofluid delivery tube is connected to a minimal quantity lubricant pumping tank, and a second end of the magnetic nanofluid delivery tube enters inside the high-pressure gas delivery tube and is fixed with the telescopic front portion.

The beneficial effects of the present invention are as follows:

(1) According to the present invention, the controllable nozzle assembly adopts a controllable telescopic structure, which can adjust the telescopic and spraying range of the nozzle at any time according to the needs during machining, so that the magnetic nanofluid sprayed by the nozzle can better act on the surface of the workpiece that produces height difference during deep grinding, making it easier to form an oil film on the surface of the workpiece and playing the role of lubrication and heat dissipation.

(2) According to the present invention, the structure of the wind deflector solves the problem of the air barrier generated by the high-speed rotation of the grinding wheel during the machining, which often makes it difficult for the grinding fluid to enter the grinding area due to the existence of the air barrier, resulting in insufficient cooling capacity of the fluid supplying method and thus causing grinding burns and deterioration of the surface integrity of the workpiece. The design of the structure of the wind deflector is beneficial to the injection of the grinding fluid into the grinding area on the one hand, and the grinding fluid with the magnetic nanoparticles is better pulled by the permanent magnet on the other hand, so that the accuracy and the machining efficiency acting on the grinding area are improved.

(3) According to the present invention, the controllable magnetic field assembly draws the sprayed magnetic nanofluid to the working surface by utilizing the traction effect of the magnetic field on the magnetic nanoparticles, which on one hand greatly reduces the harm to the environment and human body caused by the dispersion of the fine particles by the spray, and on the other hand, it can adjust the angle and position at all times, so that the formed magnetic field can better attract the magnetic nanofluid to act on the height difference of the workpiece surface caused by deep grinding, so that the workpiece surface is easier to form an oil film, which plays the role of lubrication and heat dissipation.

(4) According to the present invention, the recovering and filtering device solves the problem that magnetic nanoparticles and generated iron filings may accumulate on the end surface of permanent magnet during magnetic field-assisted grinding. The peristaltic pump continuously absorbs magnetic nanoparticles and iron filings through the generated negative pressure difference, and then separates the magnetic nanoparticles from the iron filings through the filter, which is beneficial to the recycling of magnetic nanoparticles and has the important significance of green environmental protection and resource saving.

(5) According to the present invention, the controlling and monitoring assembly can control and adjust the optimal position of the permanent magnet and the nozzle according to the needs of grinding, which is beneficial to the strong machining deep grinding of the magnetic nanofluid under different workpieces with the assistance of the magnetic field, and better exerts its excellent lubrication properties and cooling performance. The visual camera can capture the magnetic nanofluid containing the fluorescent agent while machining, and monitor the influence of the magnetic nanofluid on the surface temperature and wear of the workpiece, and then display the collected images on the display screen, which is intuitionistic and convenient.

(6) According to the present invention, using the magnetic nanofluid minimal quantity lubrication technology, the magnetic nanoparticles acting on the surface of the workpiece on the magnetic worktable have stronger cooling performance and excellent tribology characteristics, effectively solving the grinding burn, improving the surface quality of the workpiece, and achieving the low-carbon green clean production with high efficiency, low consumption, environmental friendliness and resource saving.

BRIEF DESCRIPTION OF THE DRAWINGS

The accompanying drawings constituting a part of the present invention are used to provide a further understanding of the present invention. The exemplary examples of the present invention and descriptions thereof are used to explain the present invention, and do not constitute an improper limitation of the present invention.

FIG. 4 (*b*) is a front cross-sectional view of a second table with cylinder groove of Example 1 and Example 2.

FIG. 4 (*c*) is a front cross-sectional view of a first table with cylinder groove of Example 1 and Example 2.

FIG. 15 (*b*) is a side cross-sectional view of the permanent magnet of Example 1 and Example 2.

FIG. 16 (*b*) is a cross-sectional view of the connection between a middle portion of the nozzle and a rear portion of the nozzle of Example 1 and Example 2.

FIG. 16 (*c*) is a cross-sectional view of the connection between a high-pressure gas delivery tube and the middle portion of the nozzle of Example 1 and Example 2.

FIG. 16 (*d*) is a cross-sectional view of the connection between the telescopic front portion and a nested-ring of Example 1 and Example 2.

Wherein, I controllable magnetic field assembly, II controllable nozzle assembly, III recovering and filtering device, IV controlling and monitoring assembly, V grinding wheel guard assembly;

I-1 permanent magnet, I-1-1 end face, I-1-2 place-being-cut, I-1-3 hole, I-2 first guide rail mechanism, I-2-1 rack guide rail, I-2-2 first gear, I-2-3 servo motor, I-2-4 sliding plate, I-2-5 clamping plate, I-2-6 roller, I-2-7 pillar;

II-1 nozzle, II-1-1 nozzle rear portion, II-1-2 nozzle middle portion, II-1-2-1 piston sleeve, II-1-2-2 universal bamboo joint tube, II-1-3 telescopic front portion, II-1-4 nested-ring, II-1-5 threaded sleeve, II-1-6 collar, II-2 second guide rail mechanism, II-2-1 linear guide, II-2-2 rack, II-2-3 second gear, II-2-4 slider, II-2-5 servo motor, II-3 movable plate, II-3-1 sleeve, II-3-2 fixed plate, II-3-3 long shaft, II-4 magnetic nanofluid delivery tube, II-5 high-pressure gas delivery tube, II-6 minimal quantity lubricant pump box, II-7 hydraulic drive mechanism, II-7-1 hydraulic cylinder, II-7-2 solenoid reversing valve, II-7-3 oil delivery tube;

III-1 peristaltic pump, III-1-1 peristaltic pump motor, III-1-2 third tube, III-1-3 fourth tube, III-2 filter assembly, III-2-1 inlet, III-2-2 outlet, III-2-3 second tube; IV-1 vision camera, IV-2 system control box, IV-2-1 display screen, IV-2-2 control center, IV-2-3 wireless transmission device; V-1 wind deflector, V-1-1 groove, V-1-2 first table with cylinder, V-1-3 second table with cylinder, V-1-4 first table with cylinder groove, V-1-5 second table with cylinder groove, V-2 grinding wheel, V-3 grinding wheel guard, V-3-1 spindle fixture, V-3-2 magnetic switch, V-3-3 first tube, V-4 workpiece, V-5 magnetic worktable, V-6 magnetic fixture;

1 oil tank, 2 filter, 3 hydraulic motor, 4 relief valve, 5 pressure gauge, 6 two-position two-way electromagnetic reversing valve, 7 adjustable throttle valve, 8 two-position three-way electromagnetic reversing valve, 9 adjustable one-way throttle valve, 10 hydraulic cylinder piston.

DETAILED DESCRIPTION

Figure 1:
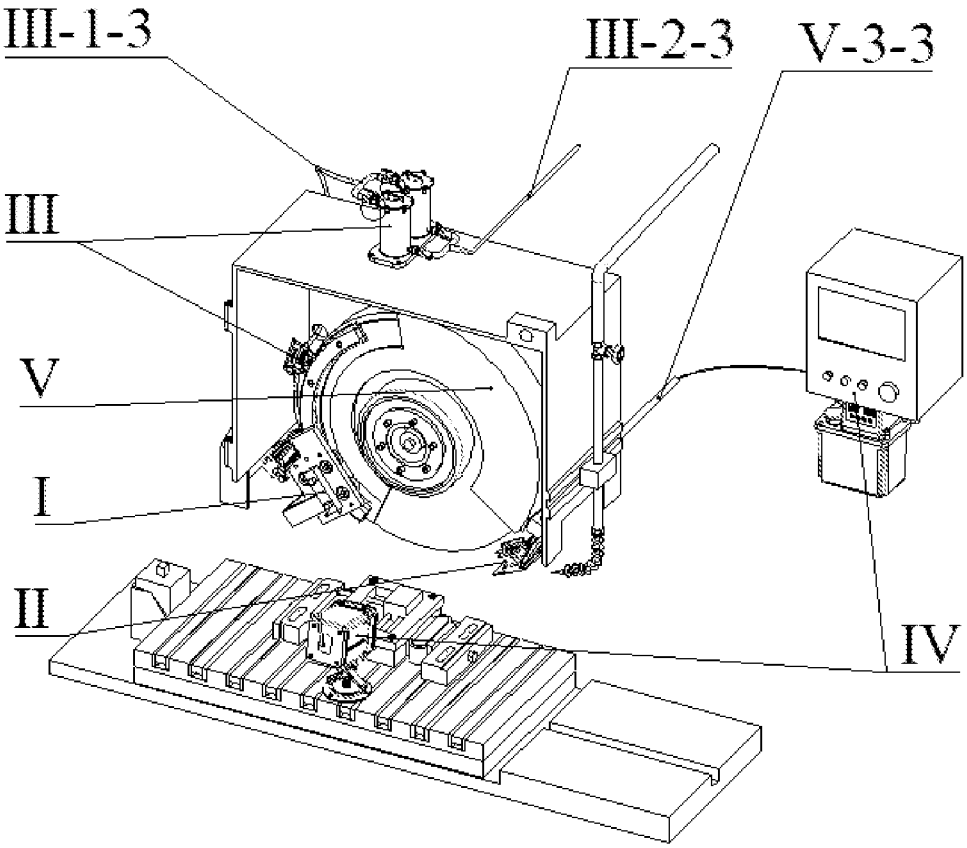
FIG. 1 is an axonometric view of a general assembly of Example 1.
Figure 2:
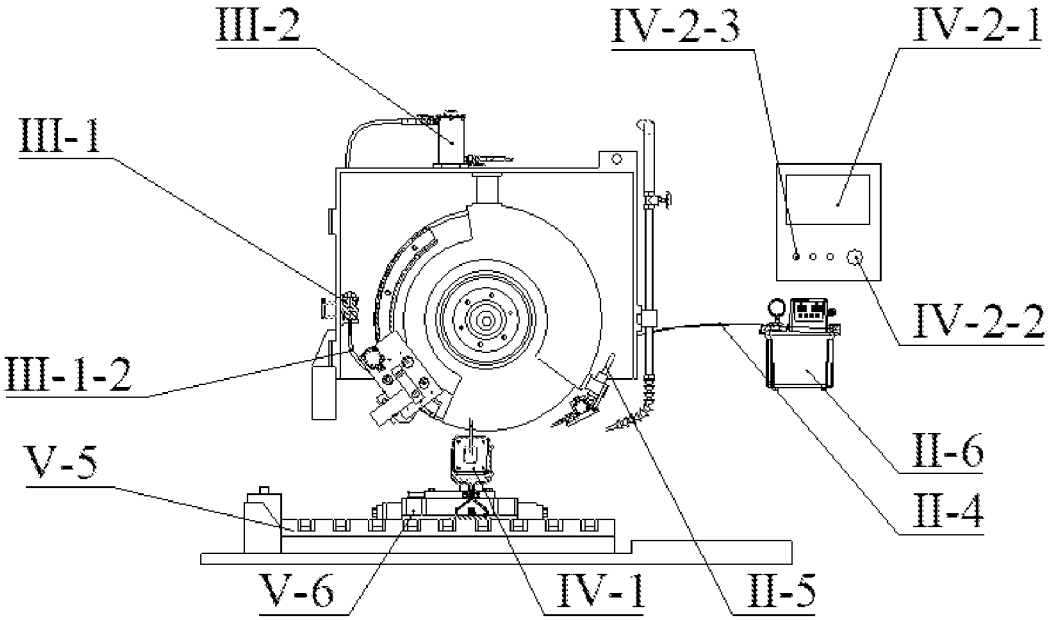
FIG. 2 is a main view of Example 1.

Example 1 the present example provides a device for supplying and recovering minimal quantity lubricant in a magnetic field-assisted abrasive grinding, as shown in FIGS. 1 and 2, comprising a controllable magnetic field assembly I, a controllable nozzle assembly II, a recovering and filtering device III, a controlling and monitoring assembly IV and a grinding wheel guard assembly V; wherein, the controllable magnetic field assembly I may adjust and change a position of a magnetic field according to the needs of machining, the controllable nozzle assembly II may adjust a length of the nozzle by stretching according to the needs of machining, and the recovering and filtering device III may separate magnetic nanoparticles from impurity iron chips after machining and further filter for recycling.

Figure 3:
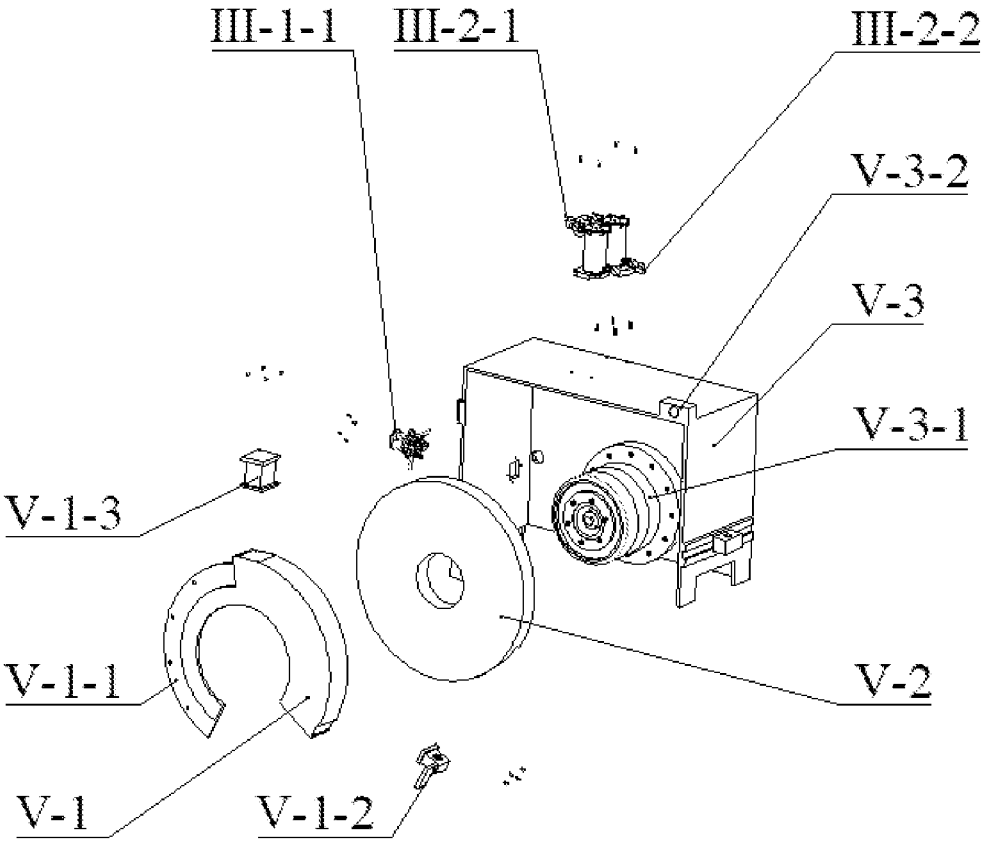
FIG. 3 is an exploded view of an internal system of a grinding wheel guard of Example 1 and Example 2.

As shown in FIG. 3, the grinding wheel guard assembly V comprises a wind deflector V-1, a grinding wheel V-2, a grinding wheel guard V-3, a magnetic worktable V-5, and a magnetic fixture V-6, wherein the magnetic worktable V-5 is mounted on a lower side of the grinding wheel guard V-3, and the magnetic fixture V-6 for clamping the workpiece V-4 is mounted on the magnetic worktable V-5.

The spindle fixture V-3-1 is mounted in the grinding wheel guard V-3, the grinding wheel V-2 is mounted on the spindle fixture V-3-1, and the wind deflector V-1 is mounted on an outer side of the grinding wheel V-2 in a circumferential direction. The wind deflector V-1 is coated on the outer side of the grinding wheel V-2 and is in a circular arc shape, and an opening is formed on a lower side of the wind deflector; a first side of the wind deflector V-1 is provided with an arc-shaped groove V-1-1, and the controllable magnetic field assembly I is arranged through the groove V-1-1. As shown in FIG. 3, the grinding wheel guard V-3 is of a box structure, and a plurality of holes for tubes to pass through are formed thereon; a first tube V-3-3 passes through an outer wall of a first side of the grinding wheel guard V-3.

Figure 4:
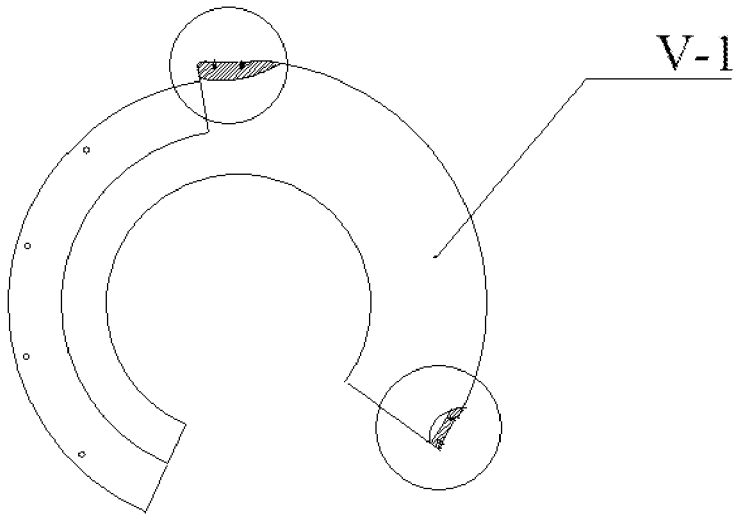
FIG. 4 (*a*) is a front view of a wind deflector of Example 1 and Example 2.
Figure 4:
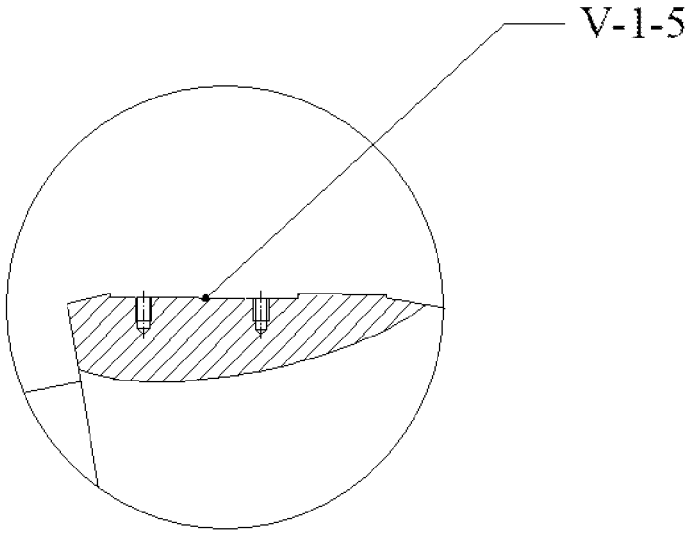
Figure 4:
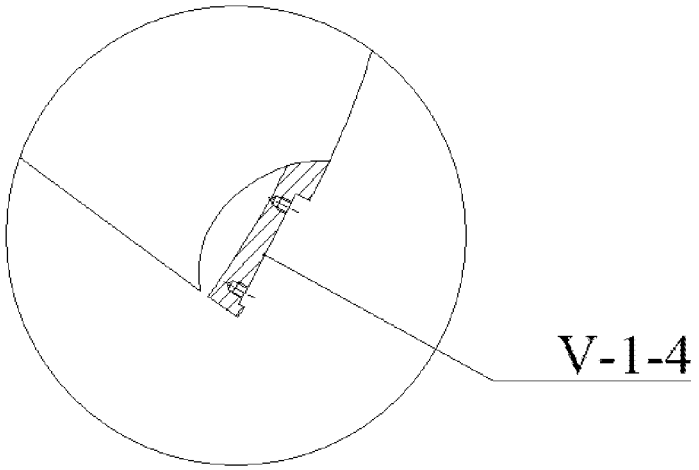

As shown in FIGS. 4 (*a*) and 4 (*c*), a first table with cylinder groove V-1-4 is arranged on the side of the wind deflector V-1 with the opening, a first table with cylinder V-1-2 is mounted by the first table with cylinder groove V-1-4 and is used for mounting the controllable nozzle assembly II. As shown in FIGS. 4 (*a*) and 4 (*b*), a second table with cylinder groove V-1-5 is arranged at a joint of the wind deflector V-1 and the groove V-1-1, a second table with cylinder V-1-3 is mounted by the second table with cylinder groove V-1-5 and is connected to an inner wall—on a top of the grinding wheel guard V-3.

Figure 5:
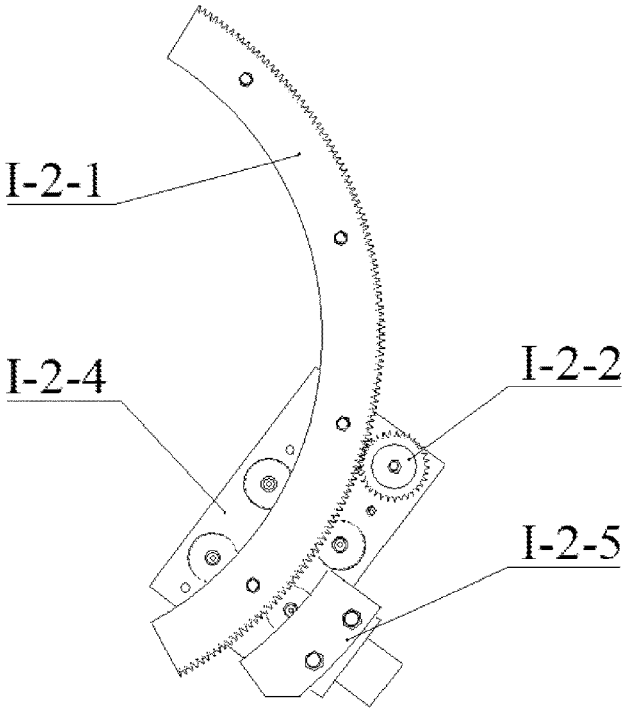
FIG. 5 is a rear view of a first guide rail mechanism of Example 1 and Example 2.
Figure 6:
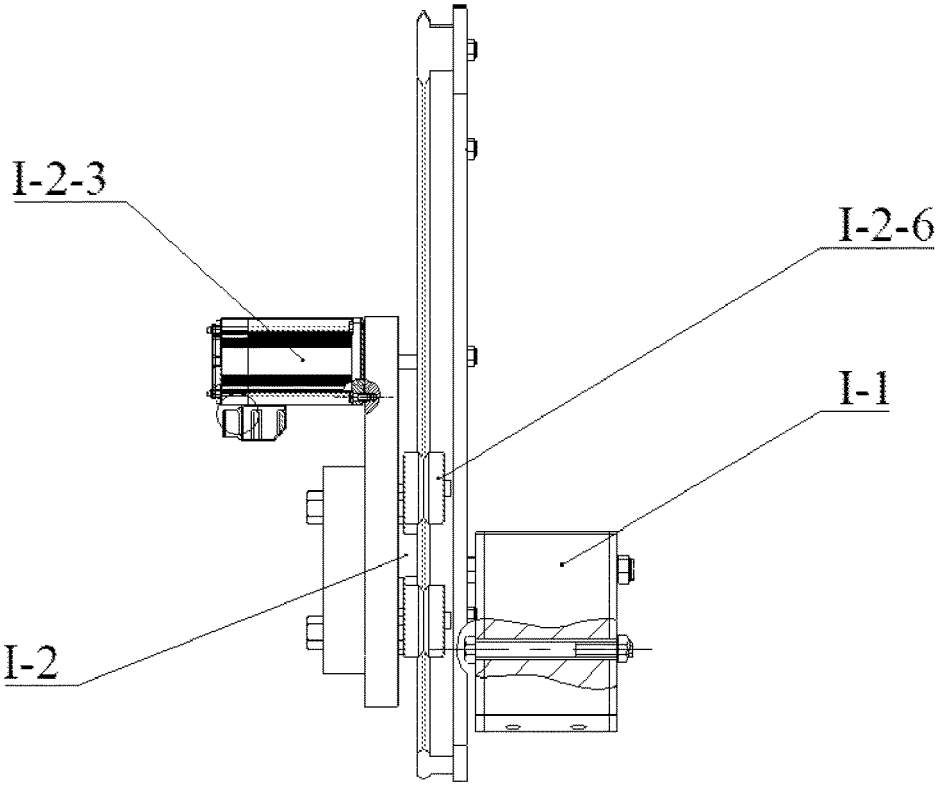
FIG. 6 is a side cross-sectional view of the first guide rail mechanism of Example 1 and Example 2.
Figure 7:
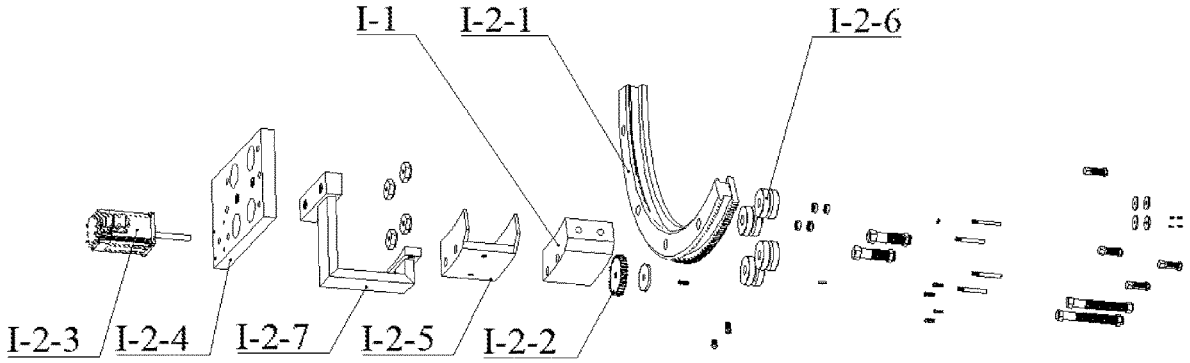
FIG. 7 is an exploded view of the first guide rail mechanism of Example 1 and Example 2.

The controllable magnetic field assembly I comprises a permanent magnet I-1 and a first guide rail mechanism I-2, wherein the first guide rail mechanism I-2 is mounted in the groove V-1-1, and the permanent magnet I-1 is connected to the first guide rail mechanism I-2. Specifically, as shown in FIGS. 5 to 7, the first guide rail mechanism I-2 comprises a rack guide rail I-2-1, a first gear I-2-2, a sliding plate I-2-4, a servo motor I-2-3, a roller I-2-6, etc., the rack guide rail I-2-1 is in an arc shape adapted to the groove V-1-1 and is connected to the groove V-1-1 through bolts, and the rack guide rail I-2-1 is convex towards the outside.

In the present example, an outer side of the rack guide rail I-2-1 is provided with teeth, so the rack guide rail I-2-1 may engage with the first gear I-2-2. The first gear I-2-2 is mounted on the sliding plate I-2-4 and is located on a first side of the sliding plate I-2-4. A servo motor I-2-3 is mounted on a second side of the sliding plate I-2-4, and the servo motor I-2-3 is connected to the first gear I-2-2. In the present example, the sliding plate I-2-4 is a rectangular plate.

The surface of the first side of the sliding plate I-2-4 on which the first gear I-2-2 is mounted is taken as a back surface, and the back surface of the sliding plate I-2-4 is further provided with two groups of rollers I-2-6, and the rollers I-2-6 are rotationally connected with the sliding plate I-2-4. Wherein, a plurality of rollers I-2-6 in each the group are arranged at intervals along an extending direction of the rack guide rail I-2-1, and the rollers I-2-6 contact a side wall of the rack guide rail I-2-1 to play a guiding role; under a driving action of the servo motor I-2-3, the first gear I-2-2 rotates, and the sliding plate I-2-4 may make a circular motion of a certain angle along the arc-shaped rack guide rail I-2-1 under the action of the rollers I-2-6.

In the present example, two rollers are provided in each the group of the rollers I-2-6.

Figure 8:
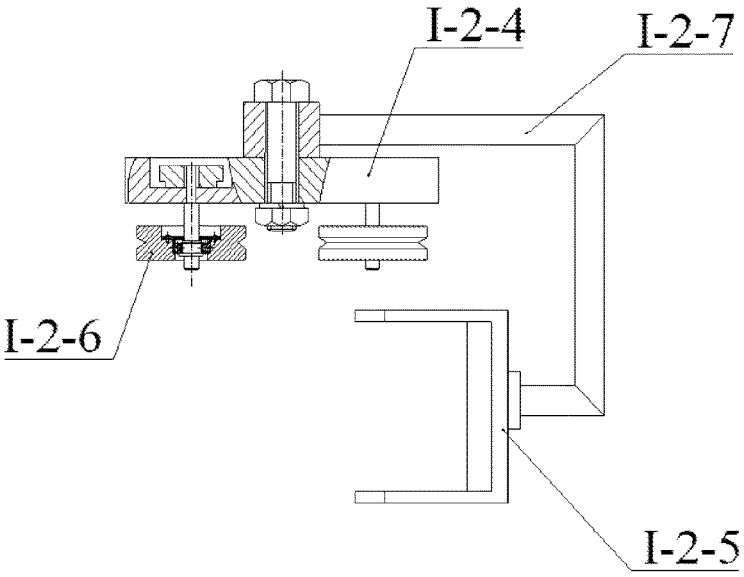
FIG. 8 is a side cross-sectional view of the connection between a clamp plate and a sliding plate of Example 1 and Example 2.
Figure 9:
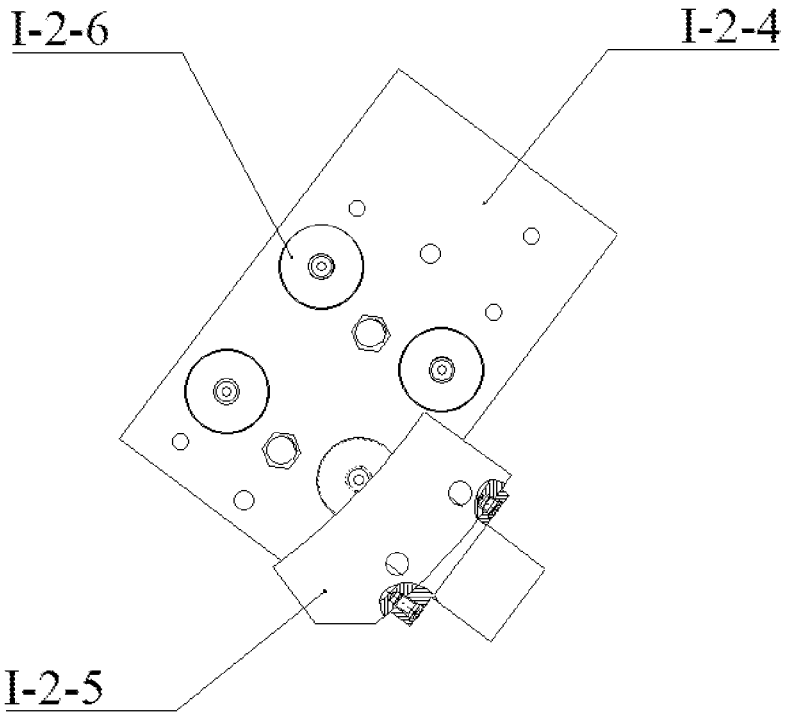
FIG. 9 is a front view of the connection between the clamping plate and the sliding plate of Example 1 and Example 2.

As shown in FIGS. 8 and 9, the sliding plate I-2-4 is connected with a clamping plate I-2-5 through the pillar I-2-7, a first end of the pillar I-2-7 is connected to a front surface of the sliding plate I-2-4 through bolts, and a second end of the pillar I-2-7 is connected to the clamping plate I-2-5. The pillar I-2-7 is of a bending structure. In the present example, the pillar I-2-7 comprises a first horizontal section, a vertical section and a second horizontal section which are connected in sequence, wherein a length of the second horizontal section is less than that of the first horizontal section, and the clamping plate I-2-5 is provided on the second horizontal section. The clamping plate I-2-5 is of a U-shaped structure.

The permanent magnet I-1 is connected in the clamping plate I-2-5 through bolts, in the present example, the permanent magnet I-1 is a cylinder with a certain radian, and is coaxial with the grinding wheel V-2, and the permanent magnet I-1 can perform a circular arc motion at a certain angle under the driving of the sliding plate I-2-4, so as to adjust the position of the permanent magnet I-1, thereby facilitating an instant adjustment of a height difference between two sides of a workpiece generated by forward and backward grinding during the magnetic field-assisted abrasive grinding, and facilitating the magnetic nanofluid to better act on the surface of the workpiece.

Figure 15:
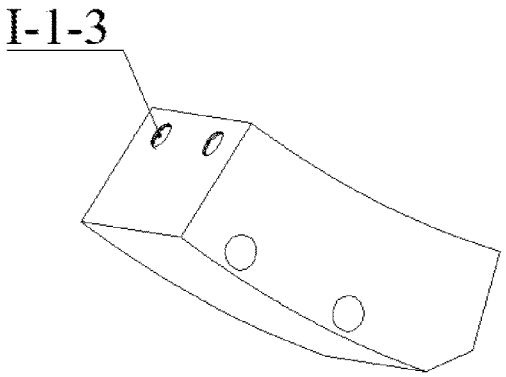
FIG. 15 (*a*) is an axonometric view of a permanent magnets of Example 1 and Example 2.
Figure 15:
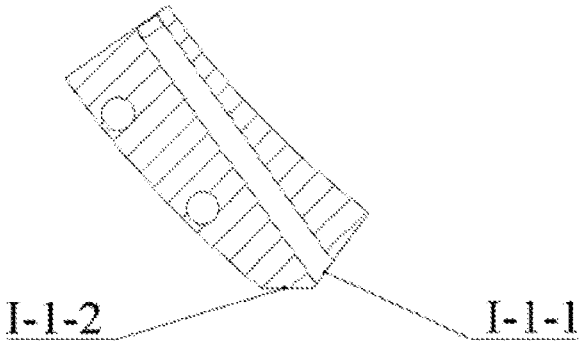

As shown in FIGS. 15 (*a*) and 15 (*b*), the permanent magnet I-1 is internally provided with a hole I-1-3 for connecting a third tube III-1-2 of a peristaltic pump III-1, an end surface of the third tube III-1-2 is flush with an end surface I-1-1 of the permanent magnet I-1, and a first side of the end surface I-1-1 is provided with an inclined place-being-cut I-1-2 for preventing collision with the workpiece when rotating and adjusting the angle of the permanent magnet I-1. A volume of the permanent magnet I-1 can be calculated according to the cylinder formula, and the parameters of permanent magnet I-1 can be selected according to actual requirements.

During magnetic field-assisted abrasive grinding process, the permanent magnet I-1 will continuously attract magnetic substances, the magnetic nanoparticles therein and iron filings generated during machining will continuously accumulate on the end face I-1-1 of the permanent magnet I-1 with the accumulation of machining time, and if it is not cleaned in time, it will affect the machining to a certain extent. Therefore, it is necessary to provide the recovering and filtering device III.

As shown in FIGS. 1 and 2, the recovering and filtering device III comprises the peristaltic pump III-1 and a filter assembly III-2, wherein the peristaltic pump III-1 is mounted on a top of the grinding wheel guard V-3 and is connected to a first end of a peristaltic pump motor III-1-1 through a fourth tube III-1-3, a second end of the peristaltic pump motor III-1-1 is connected to a third tube III-1-2 which passes through the hole I-1-3 of the permanent magnet I-1.

As shown in FIG. 3, the peristaltic pump III-1 is provided with an inlet III-2-1 and an outlet III-2-2, wherein the inlet III-2-1 is connected to the fourth tube III-1-3, and the outlet III-2-2 is connected to the second tube III-2-3. The peristaltic pump III-1, driven by the peristaltic pump motor III-1-1, absorbs the magnetic nanoparticles and iron filings retained on the end face I-1-1 of the permanent magnet I-1 through the third tube III-1-2, and conveys them to the filter assembly III-2. Since the diameter difference between the magnetic nanoparticles and the iron filings is large, the magnetic nanoparticles can be well separated from the iron filings, and then the magnetic nanoparticles are conveyed to the inside of the box structure of the grinding wheel guard V-3 through the second tube III-2-3 for post-treatment, so as to facilitate the recycling of the magnetic nanoparticles.

Figure 10:
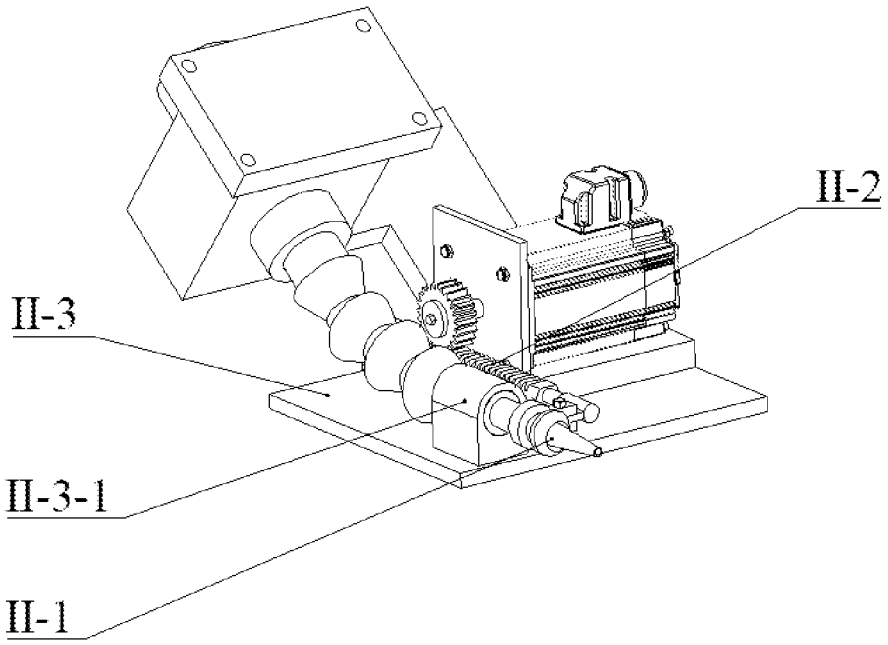
FIG. 10 is an axonometric view of a second guide rail mechanism of Example 1.
Figure 12:
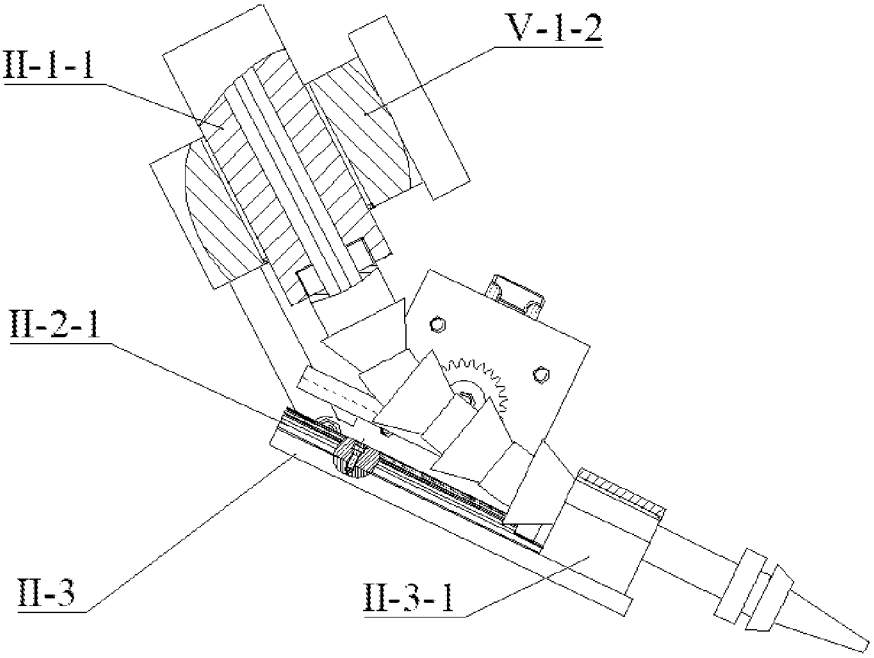
FIG. 12 is a side cross-sectional view of the second guide rail mechanism of Example 1.

As shown in FIGS. 10 and 12, the controllable nozzle assembly II comprises a nozzle II-1, a second guide rail mechanism II-2, a movable plate II-3, a magnetic nanofluid delivery tube II-4, etc., wherein the nozzle II-1 and the second guide rail mechanism II-2 are mounted on the movable plate II-3, and the nozzle II-1 is connected to a thread groove in the first table with cylinder V-1-2 through threads.

Figure 14:
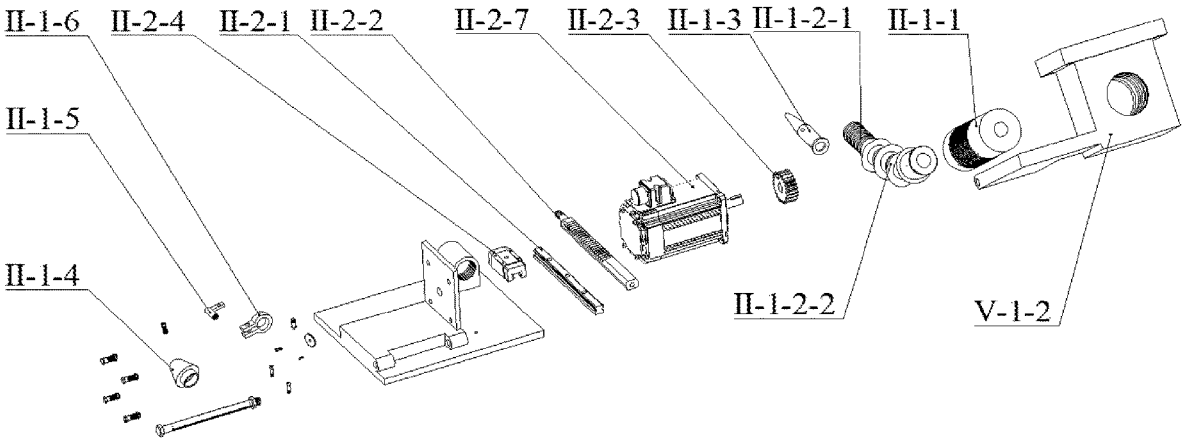
FIG. 14 is an exploded view of the second guide rail mechanism of Example 1.
Figure 16:
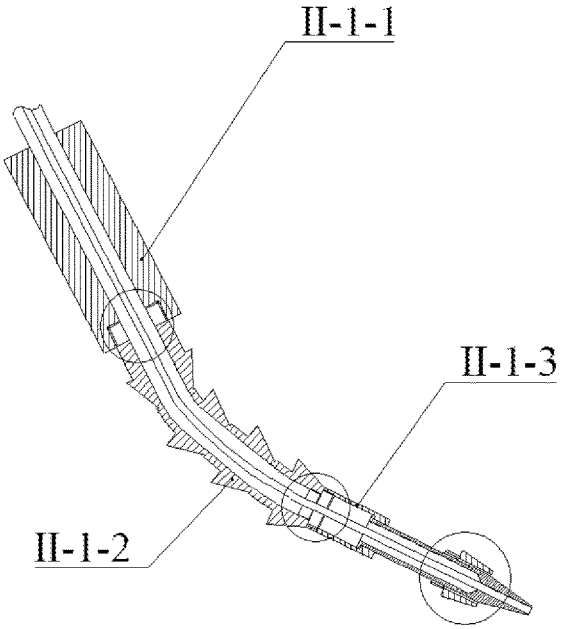
FIG. 16 (*a*) is a side cross-sectional view of a nozzle of Example 1 and Example 2.
Figure 16:
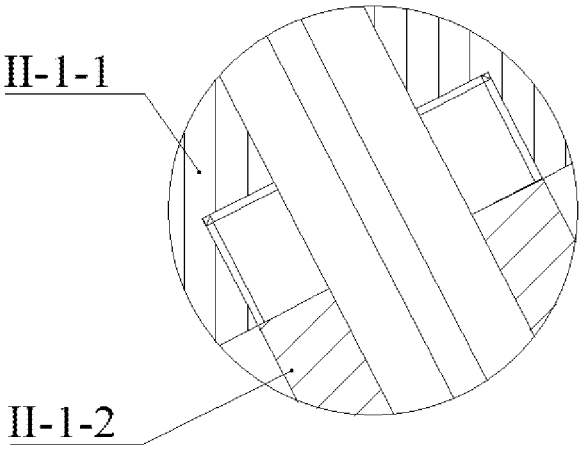
Figure 16:
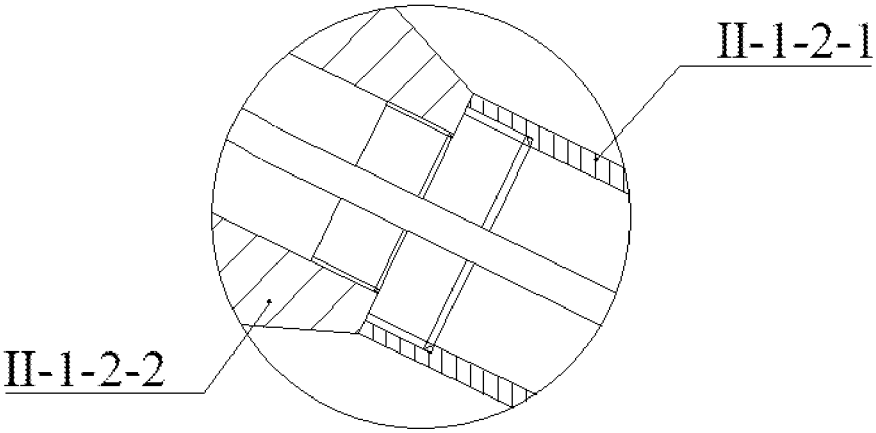
Figure 16:
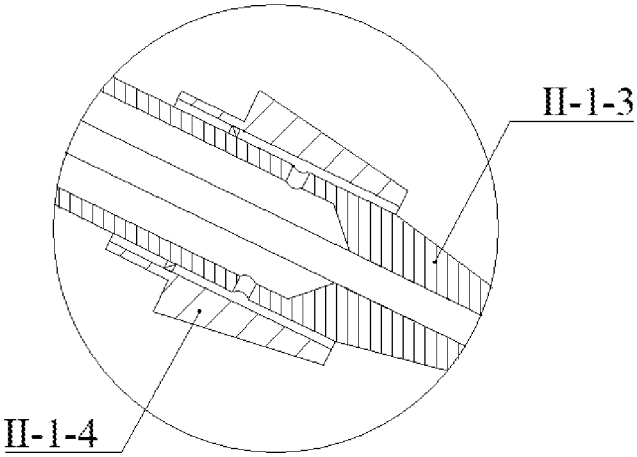
Figure 17:
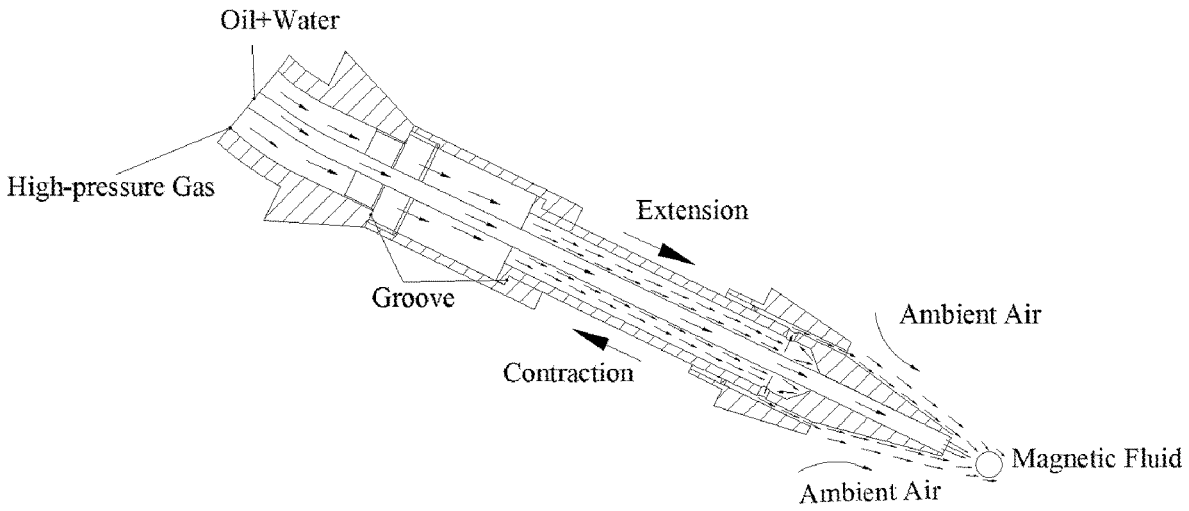
FIG. 17 is a schematic view of a telescoping motion of the nozzle and an oil-water-gas three-phase flow motion of Example 1 and Example 2.

As shown in FIGS. 14, 16 (*a*)-16 (*d*), and 17, the nozzle II-1 comprises a telescopic front section II-1-3, a middle section II-1-2 and a rear section II-1-1 which are arranged in sequence, an outer side of the telescopic front section II-1-3 is provided with a nested-ring II-1-4, the middle section II-1-2 comprises a piston sleeve II-1-2-1 and a universal bamboo joint tube II-1-2-2 connected to the piston sleeve II-1-2-1, and the telescopic front section II-1-3 is matched with the piston sleeve II-1-2-1 and can extend and contract along an inside of the piston sleeve II-1-2-1. As shown in FIG. 16 (*a*), an end of the piston sleeve II-1-2-1 is provided with a limiting bulge to prevent the telescopic front section II-1-3 from falling out. The universal bamboo joint tube II-1-2-2 can adjust the angle of the nozzle before machining, and the piston sleeve II-1-2-1 is used for the telescopic front section II-1-3 to perform telescopic movement inside it.

Figure 11:
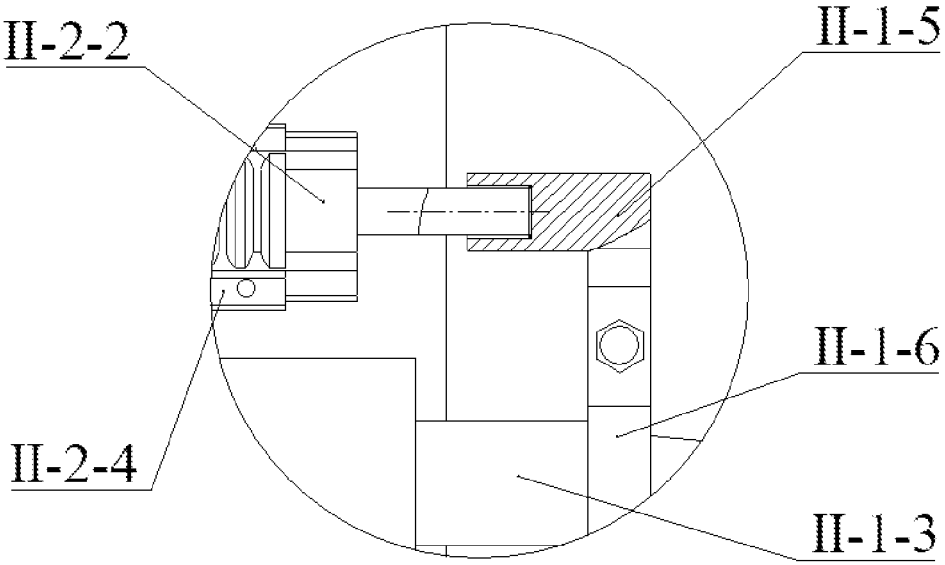
FIG. 11 is a cross-sectional view of a linear guide connected to a threaded sleeve of Example 1.
Figure 13:
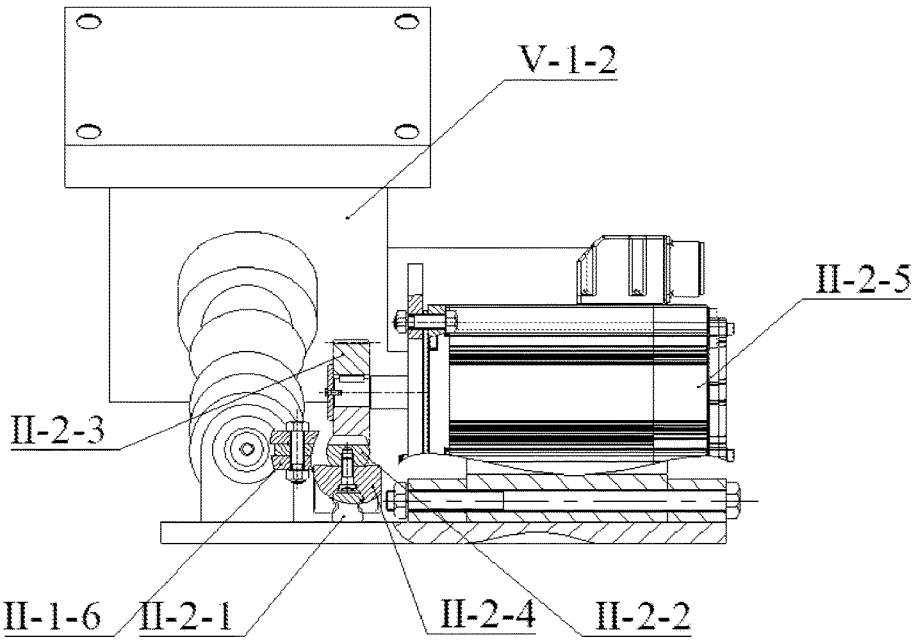
FIG. 13 is a front cross-sectional view of the second guide rail mechanism of Example 1.

As shown in FIGS. 11 and 13-14, the second guide rail mechanism II-2 comprises a second gear II-2-3, a rack II-2-2, a linear guide rail II-2-1 and a slider II-2-4, wherein the linear guide rail II-2-1 is fixed on an upper surface of the movable plate II-3, the slider II-2-4 is matched with the linear guide rail II-2-1, and the rack II-2-2 is fixed on a top of the slider II-2-4 and is parallel to the linear guide rail II-2-1. The linear guide II-2-1 and the slider II-2-4 constitute the guide assembly. The rack II-2-2 is engaged with the second gear II-2-3 and the second gear II-2-3 is connected to the servo motor II-2-5.

The telescopic front section II-1-3 is connected to a threaded sleeve II-1-5 at an end part of the rack II-2-2 through the nested-ring II-1-6, the second gear II-2-3 is rotated through the rotation of the servo motor II-2-5 to drive the rack II-2-2 to move, further to change telescopic and spraying range of the nozzle II-1, so that the height difference between two sides of a workpiece generated by forward and backward grinding during magnetic field assisted abrasive grinding is conveniently adjusted in real time, and the magnetic nanofluid is favorably acted on the surface of the workpiece.

As shown in FIG. 14, the piston sleeve II-1-2-1 is provided with external threads, a sleeve II-3-1 mounted on the movable plate II-3 is provided with internal threads, and the piston sleeve II-1-2-1 is matched with the sleeve II-3-1 through threads. The servo motor II-2-5 is fixed on the movable plate II-3 through screws, and a back side of the movable plate II-3 is rotatably connected with the second table with cylinder V-1-3. The movable plate II-3 is favorable for changing the position of the servo motor II-2-5 when the angle of the nozzle II-1 is adjusted before machining, so that the servo motor II-2-5 is kept relatively static to the nozzle II-1 to ensure the normal expansion and contraction of the nozzle II-1.

As shown in FIG. 2, a first end of the magnetic nanofluid delivery tube II-4 is connected to an oil delivery port of the minimal quantity lubricant pump box II-6, and a second end of the magnetic nanofluid delivery tube II-4 enters an interior of the high-pressure gas delivery tube II-5 from an rear end of the box structure and is clamped and fixed with an interior of the telescopic front section II-1-3, and a diameter of the magnetic nanofluid delivery tube II-4 is much smaller than a diameter of the high-pressure gas delivery tube II-5.

A first end of the high-pressure gas delivery tube II-5 is connected to the box structure through an interior of the first tube V-3-6 so as to facilitate an input of high-pressure gas at the rear end, and a second end of the high-pressure gas delivery tube II-5 enters an interior of the nozzle through firstly the hole of the grinding wheel guard V-3 and then the rear section II-1-1 of the nozzle, and is connected to the universal bamboo joint tube II-1-2-2 through threads. The first tube V-3-6 is welded and fixed with the grinding wheel guard V-3.

As shown in FIGS. 1 and 2, the controlling and monitoring system IV comprises a vision camera IV-1 and a system control box IV-2, wherein the system control box IV-2 comprises a display screen IV-2-1 and a control center IV-2-2, and a bottom of the vision camera IV-1 is adsorbed by the magnetic worktable V-5 before machining, and a function of the vision camera IV-1 is to monitor and detect the lubrication properties and cooling performance of the magnetic nanofluid on the workpiece V-4 during machining.

The vision camera IV-1 captures a movement of the magnetic nanofluid mixed with the fluorescent agent during machining, collects the images of the temperature and the wear condition of the machining surface of the workpiece, and displays the collected images on the display screen IV-2-1 through a wireless transmission device IV-2-3.

Figure 22:
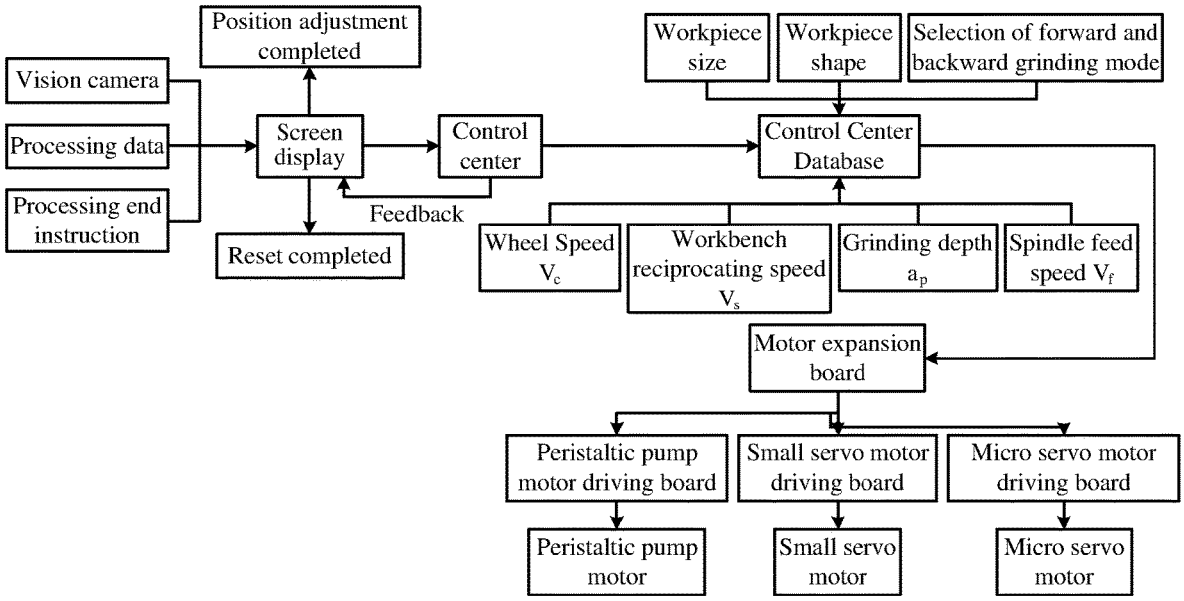
FIG. 22 is a flow chart of a principle of a control system of Example 1.

As shown in FIG. 22, during machining, inputting machining parameters (e.g. grinding wheel speed $V_c$ or grinding depth $a_p$, worktable reciprocating speed $V_s$, and spindle feed speed $V_f$) and size data of the workpiece V-4; comparing, by the control center IV-2-2, the input data with the parameter values set by the database, wherein these parameter values are set by the shape and size of the workpiece and the way of forward and backward grinding, there is an optimal machining parameter solution; then, analyzing and obtaining, by the control center IV-2-2, the optimal pulse signal amount required by the motor; and then transmitting the pulse signal to a drive board of the motor of each component through an expansion board of the motor, and then converting, by the drive board of the motor, the pulse signal into the rotation angle of the motor of each component, so as to control the position change of the permanent magnet I-1 and the nozzle II-1 and the operation of the recovering and filtering device III.

When the corresponding motor completes the corresponding angle rotation, the control center IV-2-2 will feed back information to the display screen IV-2-1 through a serial communication to display the adjustment of the position. When the machining is completed, the control center IV-2-2 receives the completion instruction and resets the permanent magnet I-1 and nozzle II-1 according to the motor rotation angle. Meanwhile, a situation of the reset will also be fed back to the display screen IV-2-1 through the means of the serial communication.

The working process of the present example is as follows:

Step 1: adsorbing, by the magnetic worktable V-5, the magnetic fixture V-6 and the bottom of the vision camera IV-1; fixing, by the magnetic fixture V-6, the workpiece V-4, positioning the grinding wheel V-2 in the machining position above the workpiece V-4, and placing the visual camera IV-1 at the angle of view facing the machining area of the grinding surface of the workpiece.

Step 2: closing the grinding wheel guard V-3, and sucking the grinding wheel guard V-3 tight by using the magnetic switch V-3-2.

Step 3: starting the grinding, and controlling, by the control system, the controllable telescopic nozzle II-1 to spray a multiphase flow spray formed by magnetic nanofluid and compressed air into the grinding area between the workpiece and the grinding wheel.

Step 4: dispersing, by using the wind deflector V-1, the air barrier layer produced by the high-speed rotation of the grinding wheel V-2, to make the multiphase flow spray from the nozzle II-1 spray to the grinding area better, and also to facilitate the traction of the magnetic nanofluid by the permanent magnet I-1.

Step 5: along with the grinding, monitoring, by the visual camera IV-1, the lubricating properties and cooling performance of the magnetic nanofluid on the workpiece V-4. Because of the characteristics of magnetic field-assisted deep grinding and the difference of forward and backward grinding, the horizontal height of the left and right sides of the surface of the workpiece V-4 will be different. The control system controls and adjusts the angular positions of the permanent magnet I-1 and the nozzle II-1, on one hand, the real-time angle adjustment is beneficial to the permanent magnet to better draw the sprayed magnetic nanofluid, and on the other hand, the permanent magnet and the surface of a workpiece form a constantly changing magnetic field area, so that the magnetic nanofluid can better form an oil film on the surface of the workpiece with height difference, and the excellent lubricating and cooling characteristics of the magnetic nanofluid are exerted.

Step 6: with the progress of grinding and the accumulation of time, continuously attracting, by the permanent magnet I-1, magnetic substances, and the magnetic nanoparticles and the iron filings generated in the machining in the magnetic substances will continuously accumulate on the end face of the permanent magnet with the accumulation of machining time. Absorbing, by the peristaltic pump III-1 driven by the peristaltic pump motor III-1-1, the magnetic nanoparticles and the iron filings retained on the end face of the permanent magnet I-1 through the recovering tube and conveying them to the recovering and filtering device III; because the diameter difference between the magnetic nanoparticles and the iron filings is large, the magnetic nanoparticles can be well separated from the iron filings, and then are conveyed to the interior of the box structure through the tube on the outlet at the other end of the recovering and filtering device III for post-treatment, so that the recycling of the magnetic nanoparticles is facilitated.

Step 7: After the machining is completed, shutting the control system down and demagnetizing the magnetic worktable V-5.

Further, in grinding, the energy consumed for removing a unit volume of material is much greater than other cutting methods, and a large amount of heat is generated in the grinding zone. The excessive grinding zone temperature will not only affect the quality of the machined surface and the service life of the grinding wheel, but also affect the performance of the lubricating fluid. When the temperature rises, the viscosity of grinding fluid will decrease, which will affect the forming ability of grinding fluid on the machined surface, and reduce the thickness and bearing capacity of lubricating oil film. As the viscosity of the grinding fluid is reduced and the fluidity is enhanced, when the grinding wheel contacts with the surface of the workpiece, it is easy to cause damage to the oil film. After the oil film is damaged, the grinding wheel will form direct contact friction with the surface of the workpiece, so that the temperature of the grinding zone rises sharply, which is very unfavorable to the grinding process, and will form a vicious circle of high temperature-viscosity of the grinding fluid is reduced—the temperature is further raised—the viscosity of the grinding fluid is further reduced.

To solve the above problems of nano minimal quantity lubrication, the present example adopts the technical solution of forming the microscopic magnetic fluid by adding magnetic nanoparticles (e.g. the nanoparticles that can conduct magnetism and show magnetism under the action of external magnetic field) into the grinding fluid, and forming an oil film with good lubrication and heat dissipation performance on the machined surface under the traction action of the superimposed magnetic field area formed by the permanent magnet I-1 and the working surface.

The Magnetic nanofluid (a mixed solution of magnetic nano-particles and grinding base fluid according to a certain proportion) enters the nozzle II-1 by flowing through the liquid path, while the compressed gas enters the nozzle II-1 by flowing through the gas path. The magnetic nanofluid and the compressed air are mixed and accelerated in the nozzle II-1 and then sprayed out.

In the present example, the angle $\alpha$ of the nozzle II-1 is set to be 15°-45°, the injection flow rate of the nozzle II-1 is 2.5-5.5 ml/min, and the pressure of the compressed air is 4.0-10 bar. The particle size of the nano particles is ≤100 nm, and the volume content of the nano particles is 1%-30 vol %. The magnetic nanofluid is prepared by selecting $Fe_3O_4$ magnetic nanoparticles with the weight fraction of 0.5 wt. %, the density is of 3.67 g/cm$^3$ and the average particle size is of 20 nm; the lubricating base oil is soybean oil (vegetable oil) and is mixed with graphene powder, a fluorescent agent and a dispersant. The magnetic $Fe_3O_4$ nanoparticles in the prepared grinding fluid can be adsorbed on the surface of graphene to form magnetic lubricating mixed particles.

Figure 23:
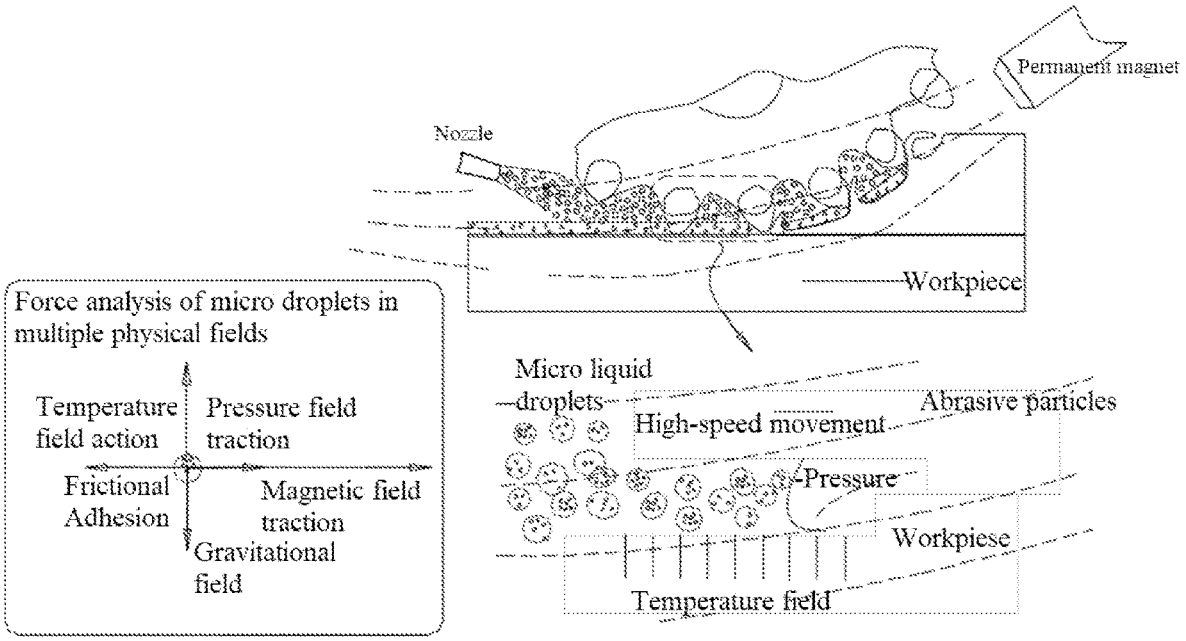
FIG. 23 is a schematic diagram of a force applied to a single droplet of the magnetic nanofluid of Example 1 and Example 2.

As shown in FIG. 23, in the present example, the model of the permanent magnet I-1 is N42, the remanence magnetic induction intensity is about 1.30 T, the maximum magnetic energy product is about 320 KJ/m$^3$, the arc angle is 20°, the width of the end face is 20 mm, and the length of the end face is 30 mm, and the magnetic field density of the magnetic field region generated by the permanent magnet I-1 and the magnetic traction force to the magnetic nanoparticles are as follows:

According to the "effective" dipole moment method, the magnetic force acting on the magnetic microstructure can be modeled by replacing a magnetic object with an "equivalent" point dipole with moment m, the force acting on the dipole being defined by $F_m$:

$$F_m = \mu_f (m_{peff} \cdot \nabla) B,$$

wherein, $\mu_f$ is the permeability of the medium, $m_{peff}$ is the "effective" dipole moment of the object, and B is the magnetic field generated by an external source at the center of the object, where the dipole of the equivalent point is located. The dipole moment m is related to the volume and magnetic properties of an object and can be described as:

$$m = MV,$$

wherein, M and V are the magnetization and the dipole volume, respectively. The force exerted on such a dipole changes the characteristics of the magnetic field source. It also depends on the distance between the source and target objects. Considering the permanent magnet in the present example, the magnetic field density of the grinding zone can be defined by:

$$B = \frac{\mu_0}{4\pi}\left(\frac{3(m\cdot r)\cdot r}{|r|^5} - \frac{m}{|r|^3}\right),$$

wherein, $\mu_0$ is the permeability of vacuum ($4\pi\times10^{-7}$T·m/A=$4\pi\times10^{-5}$T·cm/A), r is the distance vector from the source to the object. Under the situation of dispersing the gas barrier layer by the wind deflector, the range of the horizontal distance from the permanent magnet I-1 to the nozzle II-1 is about 10-15 cm, and the range of the horizontal distance from the workpiece V-4 to the permanent magnet I-1 is about 5-8 cm.

The arc angle of the permanent magnet is 20°, the width of the end face is 20 mm, and the length of the end face is 30 mm. Therefore, the volume of the permanent magnet is calculated as 31.42 $cm^3$ according to the formula $$\frac{1}{18}\pi(r_1^2 - r_2^2)L,$$

wherein $r_1$ is the radius of the large arc and is of 16 cm, and $r_2$ is the radius of the small arc and is of 14 cm. Since the volume of the hole required for fixation and recovery is about 3.04 $cm^3$, the residual volume of the permanent magnet is about 28.38 $cm^3$, and the magnetization is converted to SI units of 10342.61 A/cm according to the maximum magnetic energy product, and B at the nozzle is $2.96\times10^{-3}$ T by preliminary calculation. When the magnetic field density reaches the remanence intensity of the permanent magnet, the distance from the permanent magnet to the nozzle is about 1.71 cm, and according to the above formula, it can be seen that the magnetic nanofluid will be subjected to the traction force of the magnetic field when it is sprayed from the nozzle. However, the traction force is small at the beginning because the relationship between the magnetic induction intensity of the permanent magnet and the distance is about the inverse ratio of the third power. Therefore, when the magnetic nanofluid gradually enters deeply into the magnetic field area, the traction force it receives will gradually increase and reach the maximum value Magnetic nanofluid can be regarded as composed of numerous single micro-droplets, and a single micro-droplet contains numerous magnetic nanoparticles, so the magnetic nanoparticles should be analyzed first.

If the magnetic field effect is mainly considered, according to the force balance equation, the motion equation of the magnetic nanoparticles is written in vector form as:

$$\overrightarrow{F_m} + \overrightarrow{F_d} + \overrightarrow{F_g} = m\vec{a},$$

Wherein, $\overrightarrow{F_m}$ represents the magnetic force applied to the magnetic nanoparticles, $\overrightarrow{F_d}$ represents the viscous force applied to the magnetic nanoparticles, $\overrightarrow{F_g}$ represents the gravity applied to the magnetic nanoparticles, and $m\vec{\alpha}$ represents the inertial force. Since the magnetic nanoparticles are small in size, the gravity applied to the magnetic nanoparticles can be neglected compared with the magnetic force and the viscous force.

The magnetic force to which the magnetic nanoparticles are subjected due to the external magnetic field gradient is:

$$\overrightarrow{F_m} = \mu_0 V_p \overrightarrow{M_p}\cdot\nabla\vec{H},$$

wherein, $\mu_0$ is the vacuum magnetic permeability ($4\pi\times10^{-7}$T·m/A=$4\pi\times10^{-5}$T·cm/A), $V_p$ is the particle volume, $\overrightarrow{M_p}$ is the particle magnetization strength, and $\nabla\vec{H}$ is the magnetic field strength vector.

Since magnetic nanoparticles can be seen as spherical, the volume of magnetic nanoparticles can be calculated according to the equation of $$V_p = \frac{4}{3}\pi R_p^3,$$

wherein $R_p$ is the radius of magnetic nanoparticles (10 nm=$1\times10^{-6}$ cm), which is about $4.2\times10^{-18}$ $cm^3$.

Because in magnetic fluid, the magnetic nanoparticles will move along the direction of the magnetic induction line, so that the magnetic nanoparticles are easy to realize $\overrightarrow{M_p}$ is parallel to $\vec{H}$, the magnetization of the magnetic body can be approximately expressed as $\overrightarrow{M_p}$=X $\vec{H}$, wherein X is the difference between the magnetic susceptibility of the magnetic nanoparticles and the fluid, $X=X_p-X_f$. Generally, compared with the magnetic susceptibility $X_p$ of the magnetic nanoparticles, the magnetic susceptibility $X_f$ of the fluid is very small, and $X_f$ is often neglected, so the difference of the magnetic susceptibility can be approximately expressed as $X=X_p$.

if use $\overrightarrow{M_p}$ and $\alpha_p$ represent the magnetization and demagnetization factor of ferromagnetic particles, respectively, then the $\overrightarrow{M_p}$, $\alpha_p$ and magnetic susceptibility $X_p$ of the ferromagnetic particles are calculated respectively by the following equations:

$$\overrightarrow{M_p} = 3\alpha_p\vec{H},\ \alpha_p = \min\left(\frac{X_{p,0}}{3+X_{p,0}}, \frac{M_{p,s}}{3H}\right),\ X_p = 3\frac{\alpha_p}{1-\alpha_p},$$

wherein $X_{p,0}$ and $M_{p,s}$ represent the initial susceptibility and saturation magnetization of magnetic nanoparticles respectively, H is the magnitude of the external background magnetic field at the magnetic nanoparticles, taking $X_{p,0}$=100 SI, $M_{p,s}$=79.8 emu/g, $\alpha_{p=}$0.97, according to the formula $$H = \frac{B}{\mu}, \mu = \mu_0(1 + X),$$

then obtaining that μ is about 0.012 T·cm/A, H at the nozzle is about 0.247 A/cm, and the magnetization of magnetic nanoparticles is about 0.72 A/cm.

And because there is no conduction current inside the magnetic fluid, so $\nabla\times\vec{H}=0$, and $\nabla(\vec{H}\cdot\vec{H})=\nabla H^2=2H\nabla H$, plus the demagnetization effect of the ferromagnetic particles of the kau rate, the magnetic force to which the magnetic nanoparticles are subjected will be simplified as:

$$\overrightarrow{F_m} = \frac{1}{2}\mu_0 V_p X_p(1 - \alpha_p)\nabla(\vec{H}^2),$$

If only the magnetic field strength in the horizontal direction is considered, the magnetic force per unit magnetic nanoparticle at the nozzle is about $2.32\times10^{-19}$ N, and the magnetic force per unit magnetic nanoparticle at the workpiece surface is about $1.09\times10^{-18}$ N.

Under the action of the magnetic field, the magnetic nanoparticles are pulled by the magnetic field, and the macroscopic performance is that the magnetic fluid moves under the action of the magnetic field, which is equivalent to the effect that the magnetic nanoparticles will give the magnetic fluid a body force, and the body force is mainly composed of the magnetic body force $\overrightarrow{F_{mv}}$ applied by the external magnetic field, which is as:

$$\overrightarrow{F_{mv}} = n\overrightarrow{F_m} = \frac{1}{2}n\mu_0 V_p X_p(1 - \alpha_p)\nabla(\vec{H}^2),$$

wherein n represents the total content of magnetic nanoparticles in the magnetic nanofluid, if it is assumed that the magnetic fluid in unit time is calculated, then the flow rate in unit time is about 0.67 ml, the magnetic nanoparticles contained therein are about 0.1 $cm^3$ according to the density and volume content thereof, and the mass is about 0.367 g, and the content of the magnetic nanoparticles in the magnetic nanofluid in unit time calculated according to the mass fraction and molar mass thereof is about $9.61\times10^{20}$, then the magnetic field force applied to the magnetic fluid in unit time at the nozzle is about 222.86 N, and the magnetic field force applied to the magnetic fluid in unit time at the surface of the workpiece is about 1047.49 N.

It can be seen from the formula of magnetic field force that the magnetic force produced by the external magnetic field on the magnetic nanoparticles is related to many parameters such as particle volume, magnetic properties of the material itself, magnetic field intensity and magnetic field gradient. The magnetic force is zero in the absence of a magnetic field or in a uniform magnetic field. The magnetic force increases with the increase of magnetic field intensity and gradient, but when the magnetic field intensity reaches a certain value and the magnetic particles are saturated, the increase of magnetic field intensity has no effect on the electromagnetic force, but the magnetic force is still proportional to the magnetic field gradient. At the same time, it can be seen that the distribution characteristics of magnetic force can be effectively changed by adjusting the magnitude and direction of magnetic field intensity and gradient through the design of external magnetic field.

In the present example, the magnetic field assisted grinding has the characteristics of deep grinding and the processing mode of forward and backward grinding. Because of this characteristic and processing mode, a height difference is formed on both sides of the workpiece surface, and the existence of this height difference makes the magnetic nanofluid unable to accurately act on the unprocessed and processed regions. The analysis of the height difference and the formed cutting depth is as follows:

The topography of the grinding surface of the workpiece V-4 is a collection of track curves of several single abrasive grains on the grinding wheel, so the grinding effect of single abrasive grain on workpiece is studied firstly. When studying the mechanism of grinding workpiece with a single abrasive grain, it is necessary to study the motion relationship between the abrasive grain and the workpiece. Here, the workpiece is selected to be 40 mm long, 30 mm wide and 20 mm high.

$v_w$ is moving speed of the workpiece and is of 0.05 m/s, and $r_s$ is the radius of the grinding wheel and is of 150 mm. Because θ is very small, $$\sin\theta \approx \theta, \theta_a^2 = 2(1 - \cos\theta_a),$$

then the rotation angle of the grinding wheel can be expressed as $\theta_a=\omega\cdot t$, wherein the angular velocity of the grinding wheel is $$\omega = \frac{v_s}{r_s},$$

wherein $v_s$ is the rotational speed of the grinding wheel and is of 30 m/s, ω is 200 rad/s, and $\theta_a$ is about 120. Combining the above equation, then obtaining $$t = \frac{d_s\theta_a}{2v_s},$$

wherein $d_s$ is the wheel diameter and is of 300 mm and t is about 0.6 s.

In the process of single abrasive cutting workpiece, the grinding parameters of single abrasive and the motion parameters of workpiece will affect the geometric relationship between single abrasive and workpiece. The moving contact arc length of single abrasive $l_k$, is mainly related to the moving speed of workpiece, the cutting depth of single abrasive, the diameter of grinding wheel and the rotating speed of grinding wheel.

According to the relative motion relationship between the grinding wheel and the workpiece, the process can be regarded as the workpiece is stationary and the trajectory AC formed by the motion action of the abrasive grain is a pendulum, and the equation of the pendulum is:

$$\begin{cases} x = r_s \sin\psi \pm v_\psi \\ y = r_s(1-\cos\psi) \end{cases},$$

wherein, $\psi$ is the angular displacement of the abrasive grain, $v_\psi$ is the horizontal movement distance of the grinding wheel, because the value of $\psi$ is small, therefore sin $\psi=\psi$, then:

$$\psi = \sqrt{1-\cos^2\psi} = \left[1-\left(\frac{r_s-a_p}{r_s}\right)^2\right]^{\frac{1}{2}} = 2\left[\frac{a_p}{d_s}-\frac{a_p^2}{d_s^2}\right]^{\frac{1}{2}} \approx 2\sqrt{\frac{a_p}{d_s}},$$

$$v_\psi = \frac{\psi \cdot v_0}{2\pi},$$

wherein, $v_0$ is the horizontal travel distance of the workpiece corresponding to each revolution of the grinding wheel, so:

$$v_\psi = \frac{\psi \cdot v_0}{2\pi} = \frac{v_w}{60n_s \times 2\pi}\psi = \frac{v_w}{60n_s \times 2\pi}\frac{r_s}{r_s}\psi = \frac{r_s v_w}{60 v_s}\psi,$$

and by the calculation, $v_\omega$ is about $4.79\times10^{-4}$ mm, and x is about $1.72\times10^{-2}$ mm.

In the grinding process, due to the properties of the workpiece material, the workpiece will also produce elastic deformation during grinding. In addition, the residual stress after grinding leads to the deformation of the workpiece surface, which makes the actual grinding track generated on the workpiece surface higher than the theoretical track. Therefore, the actual curve of the workpiece surface should be the superposition of the theoretical curve and the elastic recovery of the workpiece.

In cutting process, take the machined workpiece surface as a datum plane, the equation of the cutting depth of abrasive particles can be express as:

$$h = a_p - \frac{x^2}{d_s \cdot \left(\frac{v_w}{v_s+1}\right)^2},$$

Because the magnetic field-assisted grinding is a kind of deep grinding method, the single grinding depth is much larger than that of ordinary grinding, so if the single grinding depth $a_p$ is 5 mm, the calculated h is about 4.62 mm.

Example 2

Figure 18:
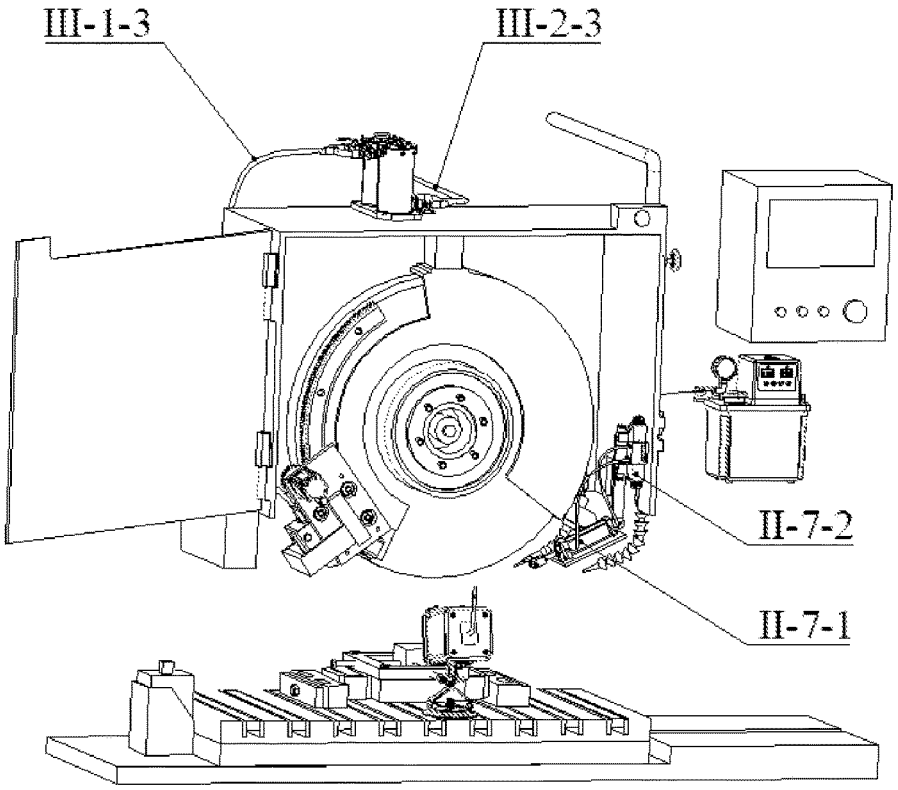
FIG. 18 is an axonometric view of a general assembly of Example 2.
Figure 19:
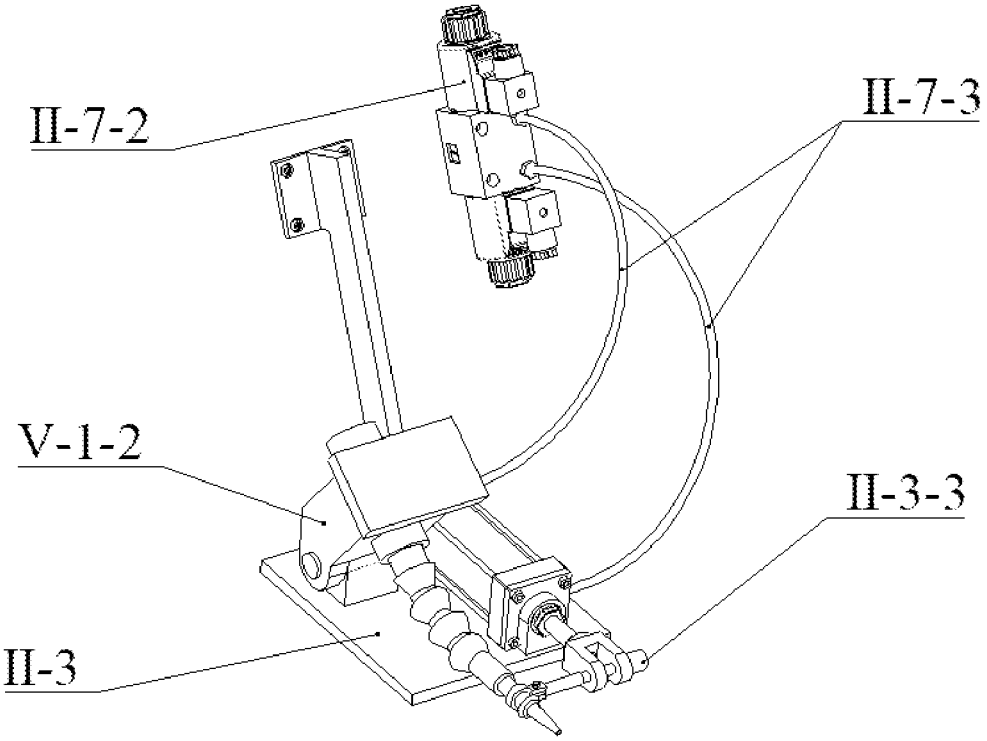
FIG. 19 is an axonometric view of the controllable telescopic nozzle system of Example 2.
Figure 20:
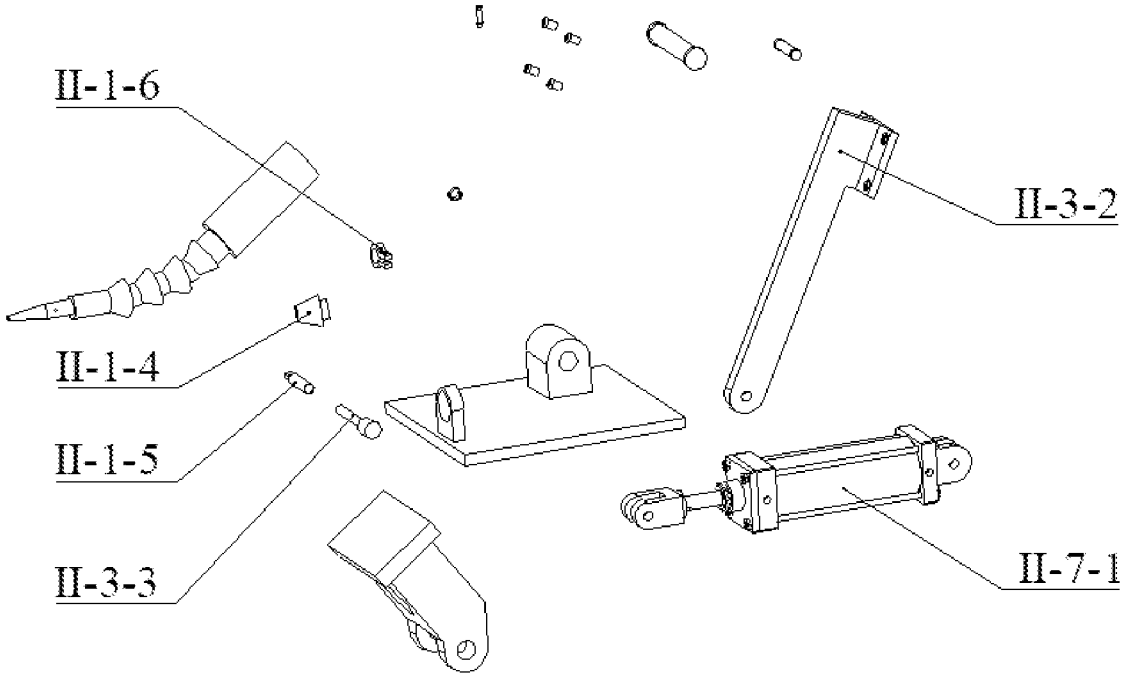
FIG. 20 is an exploded view of the controllable telescopic nozzle system of Example 2.

The present example provides a device for supplying and recovering minimal quantity lubricant in a magnetic field-assisted abrasive grinding, which differs from Example 1 in that: the control mechanism used for the controllable telescopic nozzle assembly is different. As shown in FIGS. 18-20, a first table with cylinder V-1-2 is rotatably connected to a movable plate II-3, and a nozzle II-1 is mounted on the first table with cylinder V-1-2. The present example replaces the second guide rail mechanism II-2 in Example 1 with a hydraulic drive mechanism II-7, and the hydraulic drive mechanism II-7 includes a hydraulic cylinder II-7-1, a solenoid reversing valve II-7-2 and an oil delivery tube II-7-3, wherein the hydraulic cylinder II-7-1 is fixed to an upper surface of the movable plate II-3, and the hydraulic cylinder II-7-1 is connected to the solenoid reversing valve II-7-2 through the oil delivery tube II-7-3.

As shown in FIGS. 18 and 19, a rear end of the hydraulic cylinder II-7-1 is rotatably connected to a fixed plate II-3-2, which is bolted to an inner wall of a grinding wheel guard V-3, and the solenoid reversing valve II-7-2 is mounted on an inner side of the grinding wheel guard V-3. A telescopic section of the hydraulic cylinder II-7-1 is connected to a front section of the nozzle through a long shaft II-3-3. In the present example, the solenoid reversing valve II-7-2 is a three-position four-way solenoid reversing valve. The movable plate II-3 and the fixed plate II-3-2 are favorable for changing the position of the hydraulic cylinder II-7-1 when the angle of the telescopic nozzle II-1 is adjusted before machining, so that the hydraulic cylinder II-7-1 keeps relatively static to the controllable telescopic nozzle II-1, and the normal expansion and contraction of the nozzle II-1 is ensured.

Figure 21:
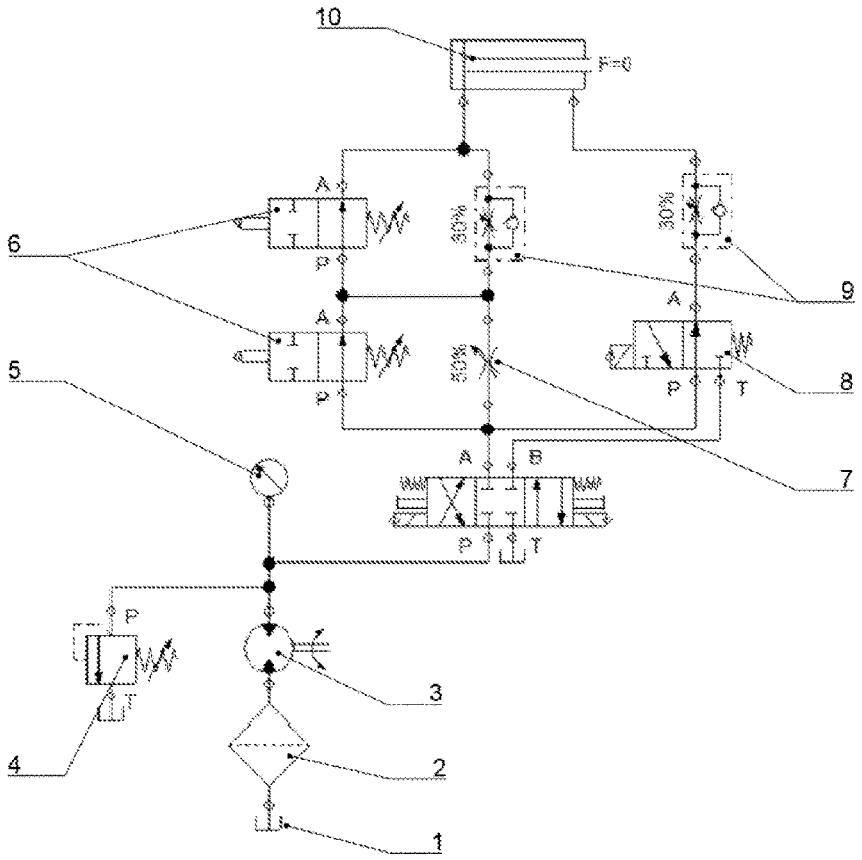
FIG. 21 is a control diagram of a hydraulic system of the controllable telescopic nozzle system of Example 2.

The hydraulic system for the extension and contraction of the controllable nozzle II-1 is shown in FIG. 21. Under the action of a hydraulic motor 3, the oil flows out of an oil tank 1, passes through a filter 2, and flows into the solenoid reversing valve II-7-2 through the oil delivery port. FIG. 21 shows an open circuit state, and if the solenoid reversing valve II-7-2 is connected to the right end through electromagnetic control, the oil flows out from a port A, and a two-position two-way solenoid reversing valve 6 on the left and a two-position three-way solenoid reversing valve 8 on the right are not energized, then the whole system is in differential connection. The oil from the left end of the hydraulic cylinder II-7-1 pushes a hydraulic cylinder piston 10 to move to the right, which is reflected as the hydraulic cylinder II-7-1 fast forward, which can achieve the rapid extension of the nozzle II-1.

If one or two of the two-position two-way solenoid reversing valves 6 on the left are energized, the oil will flow into the hydraulic cylinder II-7-1 through a throttle valve 7 and a one-way throttle valve 9 with different opening degrees, which is reflected as hydraulic cylinder II-7-1 in a working speed, so as to achieve the extension of nozzle II-1 in different speeds. If the solenoid reversing valve II-7-2 is connected to the left position, the oil on the right side of the hydraulic cylinder II-7-1 will push the piston 10 to move to the left, and the oil on the left side of the hydraulic cylinder II-7-1 will return to the oil tank 1, which is reflected as the hydraulic cylinder II-7-1 snap back and the quick contraction of the nozzle II-1. Similarly, if one or two of the right two-position two-way solenoid reversing valves 6 are energized, the nozzle II-1 can be contracted at different speeds. The throttle valve 7 and the one-way throttle valve 9 shown in the figures are adjustable, and their opening can be changed to adjust the speed under different working conditions. The pressure gauge 5 and the overflow valve 4 are used to prevent the system pressure from being too high, so that the system can work normally.

The foregoing descriptions are merely preferred embodiments of the present invention but are not intended to limit the present invention. A person skilled in art may make various alterations and variations to the present invention. Any modification, equivalent replacement, or improvement made within the spirit and principle of the present invention shall fall within the protection scope of the present invention.

The invention claimed is:

1. A device for supplying and recovering a minimal quantity lubricant in a magnetic field-assisted abrasive grinding, comprising:

a grinding wheel guard assembly, comprising a grinding wheel guard, a grinding wheel mounted inside the grinding wheel guard, and a wind deflector provided on an outside of the grinding wheel; a magnetic worktable mounted on a lower side of the grinding wheel guard, and a magnetic clamp provided on a surface of the magnetic worktable;

a controllable magnetic field assembly, comprising a permanent magnet and a first guide rail mechanism mounted on a surface of a first side of the wind deflector, the permanent magnet is connected to the first guide rail mechanism to move in a circular direction along the grinding wheel; the permanent magnet is also connected to a recovering and filtering device;

a controllable nozzle assembly, being connected to the wind deflector and located on an opposite side of the wind deflector with respect to the controllable magnetic field assembly, comprising a nozzle, being connected to a linear motion mechanism; and a controlling and monitoring assembly, comprising a vision camera disposed on the magnetic worktable for obtaining images of temperature and wear conditions of a machined surface of a workpiece; the vision camera is connected to a system control box.

2. The device for supplying and recovering the minimal quantity lubricant in the magnetic field-assisted abrasive grinding according to claim 1, wherein the grinding wheel is mounted in the grinding wheel guard through a spindle clamp;

the first side of the wind deflector is provided with a groove, being in a circular arc shape, for mounting the first guide rail mechanism.

3. The device for supplying and recovering the minimal quantity lubricant in the magnetic field-assisted abrasive grinding according to claim 2, wherein the first guide rail mechanism comprises an arc-shaped rack guide rail being fixed to the wind deflector and being engaged with a gear being connected to a servo motor;

the gear is mounted on a sliding plate, a clamp plate is connected to the sliding plate through a pillar, and the permanent magnet is mounted in the clamp plate.

4. The device for supplying and recovering the minimal quantity lubricant in the magnetic field-assisted abrasive grinding according to claim 3, wherein both sides of the arc-shaped rack guide rail are in contact with several rollers being mounted on the sliding plate.

5. The device for supplying and recovering the minimal quantity lubricant in the magnetic field-assisted abrasive grinding according to claim 1, wherein the first guide rail mechanism comprises an arc-shaped rack guide rail being fixed to the wind deflector and being engaged with a gear being connected to a servo motor;

the gear is mounted on a sliding plate, a clamp plate is connected to the sliding plate through a pillar, and the permanent magnet is mounted in the clamp plate.

6. The device for supplying and recovering the minimal quantity lubricant in the magnetic field-assisted abrasive grinding according to claim 5, wherein both sides of the arc-shaped rack guide rail are in contact with several rollers being mounted on the sliding plate.

7. The device for supplying and recovering the minimal quantity lubricant in the magnetic field-assisted abrasive grinding according to claim 1, wherein the recovering and filtering device comprises a peristaltic pump and a filtering assembly, an outlet end of the peristaltic pump being mounted on a top of the grinding wheel guard is connected to a second tube, an inlet end of the peristaltic pump is connected to a first end of a peristaltic pump motor through a fourth tube, a second end of the peristaltic pump motor is connected to a third tube which passes through a hole inside the permanent magnet.

8. The device for supplying and recovering the minimal quantity lubricant in the magnetic field-assisted abrasive grinding according to claim 1, wherein the nozzle is connected to the wind deflector through a first table with a cylindrical surface, and comprises a telescopic front portion, a middle portion and a rear portion set in sequence, and the linear motion mechanism is connected to the telescopic front portion;

the nozzle is connected to a high-pressure gas delivery tube, and a first end of a magnetic nanofluid delivery tube is connected to a minimal quantity lubricant pumping tank, and a second end of the magnetic nanofluid delivery tube enters inside the high-pressure gas delivery tube and is fixed with the telescopic front portion.

9. The device for supplying and recovering the minimal quantity lubricant in the magnetic field-assisted abrasive grinding according to claim 8, wherein the middle portion of the nozzle comprises a universal bamboo joint tube and a piston sleeve connected to the universal bamboo joint tube;

the telescopic front portion is matched with the piston sleeve and is capable of telescopic movement along an inside of the piston sleeve.

10. The device for supplying and recovering the minimal quantity lubricant in the magnetic field-assisted abrasive grinding according to claim 9, wherein the linear motion mechanism is a second guide rail mechanism being connected to a servo motor;

the second guide rail mechanism comprises a guide assembly, a rack mounted in the guide assembly, the rack engaging with a gear.

11. The device for supplying and recovering the minimal quantity lubricant in the magnetic field-assisted abrasive grinding according to claim 8, wherein the linear motion mechanism is a second guide rail mechanism being connected to a servo motor;

the second guide rail mechanism comprises a guide assembly, a rack mounted in the guide assembly, the rack engaging with a gear.

12. The device for supplying and recovering the minimal quantity lubricant in the magnetic field-assisted abrasive grinding according to claim 8, wherein the nozzle is rotatably connected to a movable plate through the first table with the cylindrical surface, and the linear motion mechanism adopts a hydraulic driving mechanism.

13. The device for supplying and recovering the minimal quantity lubricant in the magnetic field-assisted abrasive grinding according to claim 12, wherein the hydraulic driving mechanism comprises a hydraulic cylinder, a solenoid reversing valve and an oil delivery tube, the hydraulic cylinder being connected to the solenoid reversing valve via the oil delivery tube.

* * * * *